US010947981B2

(12) United States Patent
Stiles

(10) Patent No.: US 10,947,981 B2
(45) Date of Patent: Mar. 16, 2021

(54) VARIABLE SPEED PUMPING SYSTEM AND METHOD

(75) Inventor: Robert Stiles, Holly springs, NC (US)

(73) Assignee: Pentair Water Pool and Spa, Inc., Cary, NC (US)

( * ) Notice: Subject to any disclaimer, the term of this patent is extended or adjusted under 35 U.S.C. 154(b) by 0 days.

(21) Appl. No.: 12/869,570

(22) Filed: Aug. 26, 2010

(65) Prior Publication Data

US 2011/0044823 A1 Feb. 24, 2011

Related U.S. Application Data

(63) Continuation of application No. 10/926,513, filed on Aug. 26, 2004, now Pat. No. 7,874,808.

(51) Int. Cl.

| | |
|---|---|
| ***F04D 15/00*** | (2006.01) |
| ***F04B 49/20*** | (2006.01) |
| ***F04D 15/02*** | (2006.01) |
| ***F04D 27/00*** | (2006.01) |
| ***E04H 4/12*** | (2006.01) |

(52) U.S. Cl.

CPC ..... *F04D 15/0066* (2013.01); *E04H 4/1245* (2013.01); *F04B 49/20* (2013.01); *F04D 15/00* (2013.01); *F04D 15/0077* (2013.01); *F04D 15/0209* (2013.01); *F04D 15/0245* (2013.01); *F04D 27/004* (2013.01)

(58) Field of Classification Search

CPC ..... F04B 49/20; F04D 15/00; F04D 15/0066; E04H 4/12; E04H 4/16; E04H 4/14

USPC ..... 417/18, 19, 42, 43; 137/565.11; 4/496

See application file for complete search history.

(56) References Cited

U.S. PATENT DOCUMENTS

| | | | |
|---|---|---|---|
| 981,213 | A | 1/1911 | Mollitor |
| 1,993,267 | A | 3/1935 | Ferguson |
| 2,238,597 | A | 4/1941 | Page |
| 2,458,006 | A | 1/1949 | Kilgore |
| 2,488,365 | A | 11/1949 | Abbott et al. |
| 2,494,200 | A | 1/1950 | Ramqvist |
| 2,615,937 | A | 10/1952 | Ludwig |
| 2,716,195 | A | 8/1955 | Anderson |
| 2,767,277 | A | 10/1956 | Wirth |
| 2,778,958 | A | 1/1957 | Hamm et al. |

(Continued)

FOREIGN PATENT DOCUMENTS

| | | |
|---|---|---|
| AU | 3940997 | 2/1998 |
| AU | 2005204246 A1 | 3/2006 |

(Continued)

OTHER PUBLICATIONS

Board Decision for Appeal 2015-007909, Reexamination Control 95/002,008, U.S. Pat. No. 7,686,587B2 dated Apr. 1, 2016.

(Continued)

*Primary Examiner* — Philip E Stimpert

(74) *Attorney, Agent, or Firm* — Husch Blackwell LLP

(57) ABSTRACT

A variable speed pumping system and an associated method for moving water of an aquatic application. The variable speed pumping system includes a water pump for moving water in connection with performance of an operation upon the water. A variable speed motor is operatively connected to drive the pump. A sensor senses a parameter of the operation performed upon the water. A controller controls speed of the motor in response to the sensed parameter of operation.

16 Claims, 3 Drawing Sheets

(56) References Cited

U.S. PATENT DOCUMENTS 2,881,337 A 4/1959 Wall
3,116,445 A 12/1963 Wright
3,191,935 A 6/1965 Decker
3,204,423 A 10/1965 Resh, Jr.
3,213,304 A 10/1965 Landerg et al.
3,226,620 A 12/1965 Elliott et al.
3,227,808 A 1/1966 Morris
3,291,058 A 12/1966 McFarlin
3,316,843 A 5/1967 Vaughan
3,481,973 A 12/1969 Wygant
3,530,348 A 9/1970 Connor
3,558,910 A 1/1971 Dale et al.
3,559,731 A 2/1971 Stafford
3,562,614 A 2/1971 Gramkow
3,566,225 A 2/1971 Paulson
3,573,579 A 4/1971 Lewus
3,581,895 A 6/1971 Howard et al.
3,593,081 A 7/1971 Forst
3,594,623 A 7/1971 LaMaster
3,596,158 A 7/1971 Watrous
3,613,805 A 10/1971 Lindstad
3,624,470 A 11/1971 Johnson
3,634,842 A 1/1972 Niedermeyer
3,652,912 A 3/1972 Bordonaro
3,671,830 A 6/1972 Kruger
3,726,606 A 4/1973 Peters
1,061,919 A 5/1973 Miller
3,735,233 A 5/1973 Ringle
3,737,749 A 6/1973 Schmit
3,753,072 A 8/1973 Jurgens
3,761,750 A 9/1973 Green
3,761,792 A 9/1973 Whitney
3,777,232 A 12/1973 Woods et al.
3,777,804 A 12/1973 McCoy
3,778,804 A * 12/1973 Adair ..... 340/544
3,780,759 A 12/1973 Yahle et al.
3,781,925 A 1/1974 Curtis
3,787,882 A 1/1974 Fillmore
3,792,324 A 2/1974 Suarez
3,800,205 A 3/1974 Talar
3,814,544 A 6/1974 Roberts et al.
3,838,597 A 10/1974 Montgomery et al.
3,867,071 A 2/1975 Hartley
3,882,364 A 5/1975 Wright
3,902,369 A 9/1975 Metz
3,910,725 A 10/1975 Rule
3,913,342 A 10/1975 Barry
3,916,274 A 10/1975 Lewus
3,941,507 A 3/1976 Niedermeyer
3,949,782 A 4/1976 Athey et al.
3,953,777 A 4/1976 McKee
3,956,760 A 5/1976 Edwards
3,963,375 A 6/1976 Curtis
3,972,647 A 8/1976 Niedermeyer
3,976,919 A 8/1976 Vandevier
3,987,240 A 10/1976 Schultz
4,000,446 A 12/1976 Vandevier
4,021,700 A 5/1977 Ellis-Anwyl
4,030,450 A 6/1977 Hoult
4,041,470 A 8/1977 Slane et al.
4,061,442 A 12/1977 Clark et al.
4,087,204 A 5/1978 Niedermeyer
4,108,574 A 8/1978 Bartley et al.
4,123,792 A 10/1978 Gephart et al.
4,133,058 A 1/1979 Baker
4,142,415 A 3/1979 Jung et al.
4,151,080 A 4/1979 Zuckerman et al.
4,157,728 A 6/1979 Mitamura et al.
4,168,413 A 9/1979 Halpine
4,169,377 A 10/1979 Scheib
4,182,363 A 1/1980 Fuller et al.
4,185,187 A 1/1980 Rogers
4,187,503 A 2/1980 Walton
4,206,634 A 6/1980 Taylor
4,215,975 A 8/1980 Niedermeyer
4,222,711 A 9/1980 Mayer
4,225,290 A 9/1980 Allington
4,228,427 A 10/1980 Niedermeyer
4,233,553 A 11/1980 Prince
4,241,299 A 12/1980 Bertone
4,255,747 A 3/1981 Bunia
4,263,535 A 4/1981 Jones
4,276,454 A 6/1981 Zathan
4,286,303 A 8/1981 Genheimer et al.
4,303,203 A 12/1981 Avery
4,307,327 A 12/1981 Streater et al.
4,309,157 A 1/1982 Niedermeyer
4,314,478 A 2/1982 Beaman
4,319,712 A 3/1982 Bar
4,322,297 A 3/1982 Bajka
4,330,412 A 5/1982 Frederick
4,332,527 A 6/1982 Moldovan et al.
4,353,220 A 10/1982 Curwein
4,366,426 A 12/1982 Turlej
4,369,438 A 1/1983 Wilhelmi
4,370,098 A 1/1983 McClain et al.
4,370,690 A 1/1983 Baker
4,371,315 A 2/1983 Shikasho
4,375,613 A 3/1983 Fuller et al.
4,384,825 A 5/1983 Thomas et al.
4,394,262 A 7/1983 Bukowski et al.
4,399,394 A 8/1983 Ballman
4,402,094 A 9/1983 Sanders
4,409,532 A 10/1983 Hallenbeck
4,419,625 A 12/1983 Bejot et al.
4,420,787 A 12/1983 Tibbits et al.
4,421,643 A 12/1983 Frederick
4,425,836 A 1/1984 Pickrell
4,427,545 A 1/1984 Arguilez
4,428,434 A 1/1984 Gelaude
4,429,343 A 1/1984 Freud
4,437,133 A 3/1984 Rueckert
4,448,072 A 5/1984 Tward
4,449,260 A 5/1984 Whitaker
4,453,118 A 6/1984 Phillips
4,456,432 A 6/1984 Mannino
4,462,758 A 7/1984 Speed
4,463,304 A 7/1984 Miller
4,468,604 A 8/1984 Zaderej
4,470,092 A 9/1984 Lombardi
4,473,338 A 9/1984 Garmong
4,494,180 A 1/1985 Streater
4,496,895 A 1/1985 Kawate et al.
4,504,773 A 3/1985 Suzuki et al.
4,505,643 A * 3/1985 Millis et al. ..... 417/12
D278,529 S 4/1985 Hoogner
4,514,989 A 5/1985 Mount
4,520,303 A 5/1985 Ward
4,529,359 A 7/1985 Sloan
4,541,029 A 9/1985 Ohyama
4,545,906 A 10/1985 Frederick
4,552,512 A 11/1985 Gallup et al.
4,564,041 A 1/1986 Kramer
4,564,882 A 1/1986 Baxter
4,581,900 A 4/1986 Lowe
4,604,563 A 8/1986 Min
4,605,888 A 8/1986 Kim
4,610,605 A 9/1986 Hartley
4,620,835 A 11/1986 Bell
4,622,506 A 11/1986 Shemanske
4,635,441 A 1/1987 Ebbing et al.
4,647,825 A 3/1987 Profio et al.
4,651,077 A 3/1987 Woyski
4,652,802 A 3/1987 Johnston
4,658,195 A 4/1987 Min
4,658,203 A 4/1987 Freymuth
4,668,902 A 5/1987 Zeller, Jr.
4,670,697 A 6/1987 Wrege
4,676,914 A 6/1987 Mills et al.
4,678,404 A 7/1987 Lorett et al.
4,678,409 A 7/1987 Kurokawa
4,686,439 A 8/1987 Cunningham
4,695,779 A 9/1987 Yates
4,697,464 A 10/1987 Martin

(56) References Cited

U.S. PATENT DOCUMENTS 4,703,387 A 10/1987 Mller
4,705,629 A 11/1987 Weir
4,716,605 A 1/1988 Shepherd
4,719,399 A 1/1988 Wrege
4,728,882 A 3/1988 Stanbro
4,751,449 A 6/1988 Chmiel
4,751,450 A 6/1988 Lorenz
4,758,697 A 7/1988 Jeuneu
4,761,601 A 8/1988 Zaderej
4,764,417 A 8/1988 Gulya
4,764,714 A 8/1988 Alley
4,766,329 A 8/1988 Santiago
4,767,280 A 8/1988 Markuson
4,780,050 A 10/1988 Caine et al.
4,781,525 A 11/1988 Hubbard
4,782,278 A 11/1988 Bossi
4,786,850 A 11/1988 Chmiel
4,789,307 A 12/1988 Sloan
4,795,314 A 1/1989 Prybella et al.
4,801,858 A 1/1989 Min
4,804,901 A 2/1989 Pertessis
4,806,457 A 2/1989 Yanagisawa
4,820,964 A 4/1989 Kadah
4,827,197 A 5/1989 Giebler
4,834,624 A 5/1989 Jensen
4,837,656 A 6/1989 Barnes
4,839,571 A 6/1989 Farnham
4,841,404 A 6/1989 Marshall et al.
4,843,295 A 6/1989 Thompson
4,862,053 A 8/1989 Jordan
4,864,287 A 9/1989 Kierstead
4,885,655 A 12/1989 Springer et al.
4,891,569 A 1/1990 Light
4,896,101 A 1/1990 Cobb
4,907,610 A 3/1990 Meincke
4,912,936 A 4/1990 Denpou
4,913,625 A 4/1990 Gerlowski
4,949,748 A 8/1990 Chatrathi
4,958,118 A 9/1990 Pottebaum
4,963,778 A 10/1990 Jensen
4,967,131 A 10/1990 Kim
4,971,522 A 11/1990 Butlin
4,975,798 A 12/1990 Edwards et al.
4,977,394 A 12/1990 Manson et al.
4,985,181 A 1/1991 Strada et al.
4,986,919 A 1/1991 Allington
4,996,646 A 2/1991 Farrington
D315,315 S 3/1991 Stairs, Jr.
4,998,097 A 3/1991 Noth et al.
5,015,151 A 5/1991 Snyder, Jr. et al.
5,015,152 A 5/1991 Greene
5,017,853 A 5/1991 Chmiel
5,026,256 A 6/1991 Kuwabara
5,028,854 A 7/1991 Moline
5,041,771 A 8/1991 Min
5,051,068 A 9/1991 Wong
5,051,681 A 9/1991 Schwarz
5,076,761 A 12/1991 Krohn
5,076,763 A 12/1991 Anastos et al.
5,079,784 A 1/1992 Rist et al.
5,091,817 A 2/1992 Alley
5,098,023 A 3/1992 Burke
5,099,181 A 3/1992 Canon
5,100,298 A 3/1992 Shibata
RE33,874 E 4/1992 Miller
5,103,154 A 4/1992 Dropps
5,117,233 A 5/1992 Hamos et al.
5,123,080 A 6/1992 Gillett
5,129,264 A 7/1992 Lorenc
5,135,359 A 8/1992 Dufresne
5,145,323 A 9/1992 Farr
5,151,017 A 9/1992 Sears et al.
5,154,821 A 10/1992 Reid
5,156,535 A 10/1992 Budris
5,158,436 A 10/1992 Jensen
5,159,713 A 10/1992 Gaskell
5,164,651 A 11/1992 Hu
5,166,595 A 11/1992 Leverich
5,167,041 A 12/1992 Burkitt
5,172,089 A 12/1992 Wright et al.
D334,542 S 4/1993 Lowe
5,206,573 A 4/1993 McCleer et al.
5,213,477 A 5/1993 Watanabe et al.
5,222,867 A 6/1993 Walker, Sr. et al.
5,234,286 A 8/1993 Wagner
5,234,319 A 8/1993 Wilder
5,235,235 A 8/1993 Martin
5,238,369 A 8/1993 Farr
5,240,380 A 8/1993 Mabe
5,245,272 A 9/1993 Herbert
5,247,236 A 9/1993 Schroeder
5,255,148 A 10/1993 Yeh
5,272,933 A 12/1993 Collier
5,295,790 A 3/1994 Bossart et al.
5,295,857 A 3/1994 Toly
5,296,795 A 3/1994 Dropps
5,302,885 A 4/1994 Schwarz
5,319,298 A 6/1994 Wanzong et al.
5,324,170 A 6/1994 Anastos et al.
5,327,036 A 7/1994 Carey
5,342,176 A 8/1994 Redlich
5,347,664 A 9/1994 Hamza et al.
5,349,281 A 9/1994 Bugaj
5,351,709 A 10/1994 Vos
5,351,714 A 10/1994 Barnowski
5,352,969 A 10/1994 Gilmore et al.
5,360,320 A 11/1994 Jameson et al.
5,361,215 A 11/1994 Tompkins
5,363,912 A 11/1994 Wolcott
5,394,748 A 3/1995 McCarthy
5,418,984 A 5/1995 Livingston, Jr.
D359,458 S 6/1995 Pierret
5,422,014 A 6/1995 Allen et al.
5,423,214 A 6/1995 Lee
5,425,624 A 6/1995 Williams
5,443,368 A 8/1995 Weeks et al.
5,444,354 A 8/1995 Takahashi
5,449,274 A 9/1995 Kochan, Jr.
5,449,997 A 9/1995 Gilmore et al.
5,450,316 A 9/1995 Gaudet et al.
D363,060 S 10/1995 Hunger
5,457,373 A 10/1995 Heppe et al.
5,457,826 A 10/1995 Haraga et al.
5,466,995 A 11/1995 Genga
5,469,215 A 11/1995 Nashiki
5,471,125 A 11/1995 Wu
5,473,497 A 12/1995 Beatty
5,483,229 A 1/1996 Tamura et al.
5,495,161 A 2/1996 Hunter
5,499,902 A 3/1996 Rockwood
5,511,397 A 4/1996 Makino et al.
5,512,809 A 4/1996 Banks et al.
5,512,883 A 4/1996 Lane
5,518,371 A 5/1996 Wellstein
5,519,848 A 5/1996 Wloka
5,520,517 A 5/1996 Sipin
5,522,707 A 6/1996 Potter
5,528,120 A 6/1996 Brodetsky
5,529,462 A 6/1996 Hawes
5,532,635 A 7/1996 Watrous
5,540,555 A 7/1996 Corso et al.
D372,719 S 8/1996 Jensen
5,545,012 A 8/1996 Anastos et al.
5,548,854 A 8/1996 Bloemer et al.
5,549,456 A 8/1996 Burrill
5,550,497 A 8/1996 Carobolante
5,550,753 A 8/1996 Tompkins et al.
5,559,418 A 9/1996 Burkhart
5,559,720 A 9/1996 Tompkins
5,559,762 A 9/1996 Sakamoto
5,561,357 A 10/1996 Schroeder
5,562,422 A 10/1996 Ganzon et al.
5,563,759 A 10/1996 Nadd
D375,908 S 11/1996 Schumaker

(56) References Cited

U.S. PATENT DOCUMENTS 5,570,481 A 11/1996 Mathis et al.
5,571,000 A 11/1996 Zimmerman
5,577,890 A 11/1996 Nielson et al.
5,580,221 A 12/1996 Triezenberg
5,582,017 A 12/1996 Noji et al.
5,587,899 A 12/1996 Ho et al.
5,589,076 A 12/1996 Womack
5,589,753 A 12/1996 Kadah
5,592,062 A 1/1997 Bach
5,598,080 A 1/1997 Jensen
5,601,413 A 2/1997 Langley
5,604,491 A 2/1997 Coonley et al.
5,614,812 A 3/1997 Wagoner
5,616,239 A 4/1997 Wandell et al.
5,618,460 A 4/1997 Fowler
5,622,223 A 4/1997 Vasquez
5,624,237 A 4/1997 Prescott et al.
5,626,464 A 5/1997 Schoenmeyr
5,628,896 A 5/1997 Klingenberger
5,629,601 A 5/1997 Feldstein
5,632,468 A 5/1997 Schoenmeyr
5,633,540 A 5/1997 Moan
5,640,078 A 6/1997 Kou et al.
5,654,504 A 8/1997 Smith et al.
5,654,620 A 8/1997 Langhorst
5,669,323 A 9/1997 Pritchard
5,672,050 A 9/1997 Webber et al.
5,682,624 A 11/1997 Ciochetti
5,690,476 A 11/1997 Miller
5,708,337 A 1/1998 Breit et al.
5,708,348 A 1/1998 Frey et al.
5,711,483 A 1/1998 Hays
5,712,795 A 1/1998 Layman et al.
5,713,320 A 2/1998 Pfaff et al.
5,727,933 A 3/1998 Laskaris et al.
5,730,861 A * 3/1998 Sterghos et al. ..... 210/86
5,731,673 A 3/1998 Gilmore
5,736,884 A 4/1998 Ettes et al.
5,739,648 A 4/1998 Ellis et al.
5,744,921 A 4/1998 Makaran
5,752,785 A 5/1998 Tanaka et al.
5,754,036 A 5/1998 Walker
5,754,421 A 5/1998 Nystrom
5,763,969 A 6/1998 Metheny et al.
5,767,606 A 6/1998 Bresolin
5,777,833 A 7/1998 Romillon
5,780,992 A 7/1998 Beard
5,791,882 A 8/1998 Stucker
5,796,234 A 8/1998 Vrionis
5,802,910 A 9/1998 Krahn et al.
5,804,080 A 9/1998 Klingenberger
5,808,441 A 9/1998 Nehring
5,814,966 A 9/1998 Williamson
5,818,708 A 10/1998 Wong
5,818,714 A 10/1998 Zou
5,819,848 A 10/1998 Ramusson
5,820,350 A 10/1998 Mantey et al.
5,828,200 A 10/1998 Ligman et al.
5,833,437 A 11/1998 Kurth et al.
5,836,271 A 11/1998 Saski
5,845,225 A 12/1998 Mosher
5,856,783 A 1/1999 Gibb
5,863,185 A 1/1999 Cochimin et al.
5,883,489 A 3/1999 Konrad
5,884,205 A 3/1999 Elmore et al.
5,892,349 A 4/1999 Bogwicz
5,894,609 A 4/1999 Barnett
5,898,958 A 5/1999 Hall
5,906,479 A 5/1999 Hawes
5,907,281 A 5/1999 Miller, Jr. et al.
5,909,352 A 6/1999 Klabunde et al.
5,909,372 A 6/1999 Thybo
5,914,881 A 6/1999 Trachier
5,920,264 A 7/1999 Kim et al.
5,930,092 A 7/1999 Nystrom
5,941,690 A 8/1999 Lin
5,944,444 A 8/1999 Motz et al.
5,945,802 A 8/1999 Konrad
5,946,469 A 8/1999 Chidester
5,947,689 A 9/1999 Schick
5,947,700 A 9/1999 McKain et al.
5,959,431 A 9/1999 Xiang
5,959,534 A 9/1999 Campbell
5,961,291 A 10/1999 Sakagami et al.
5,963,706 A 10/1999 Baik
5,969,958 A 10/1999 Nielsen
5,973,465 A 10/1999 Rayner
5,973,473 A 10/1999 Anderson
5,977,732 A 11/1999 Matsumoto
5,983,146 A 11/1999 Sarbach
5,986,433 A 11/1999 Peele et al.
5,987,105 A 11/1999 Jenkins et al.
5,991,939 A 11/1999 Mulvey
6,030,180 A 2/2000 Clarey et al.
6,037,742 A 3/2000 Rasussen
6,043,461 A 3/2000 Holling et al.
6,045,331 A 4/2000 Gehm et al.
6,045,333 A 4/2000 Breit
6,046,492 A 4/2000 Machida
6,048,183 A 4/2000 Meza
6,056,008 A 5/2000 Adams et al.
6,059,536 A 5/2000 Stingl
6,065,946 A 5/2000 Lathrop
6,072,291 A 6/2000 Pedersen
6,080,973 A 6/2000 Thweatt, Jr.
6,081,751 A 6/2000 Luo
6,091,604 A 7/2000 Plougsgaard
6,092,992 A 7/2000 Imblum
6,094,026 A 7/2000 Cameron
D429,699 S 8/2000 Davis
D429,700 S 8/2000 Liebig
6,094,764 A 8/2000 Veloskey et al.
6,098,654 A 8/2000 Cohen et al.
6,102,665 A 8/2000 Centers et al.
6,110,322 A 8/2000 Teoh et al.
6,116,040 A 9/2000 Stark
6,119,707 A 9/2000 Jordan
6,121,746 A 9/2000 Fisher
6,121,749 A 9/2000 Wills et al.
6,125,481 A 10/2000 Sicilano
6,125,883 A 10/2000 Creps et al.
6,142,741 A 11/2000 Nishihata
6,146,108 A 11/2000 Mullendore
6,150,776 A 11/2000 Potter et al.
6,157,304 A 12/2000 Bennett et al.
6,164,132 A 12/2000 Matulek
6,171,073 B1 1/2001 McKain et al.
6,178,393 B1 1/2001 Irvin
6,184,650 B1 2/2001 Gelbman
6,188,200 B1 2/2001 Maiorano
6,198,257 B1 3/2001 Belehradek et al.
6,199,224 B1 3/2001 Versland
6,203,282 B1 3/2001 Morin
6,208,112 B1 3/2001 Jensen et al.
6,212,956 B1 4/2001 Donald
6,213,724 B1 4/2001 Haugen
6,216,814 B1 4/2001 Fujita et al.
6,222,355 B1 4/2001 Ohshima
6,227,808 B1 5/2001 Jensen et al.
6,232,742 B1 5/2001 Wachnov
6,236,177 B1 5/2001 Zick
6,238,188 B1 5/2001 McDonough
6,247,429 B1 6/2001 Hara
6,249,435 B1 6/2001 Lifson
6,251,285 B1 6/2001 Clochetti
6,253,227 B1 6/2001 Vicente et al.
D445,405 S 7/2001 Schneider
6,254,353 B1 7/2001 Polo
6,257,304 B1 7/2001 Jacobs et al.
6,257,833 B1 7/2001 Bates
6,259,617 B1 7/2001 Wu
6,264,431 B1 7/2001 Trizenberg
6,264,432 B1 7/2001 Kilayko et al.
6,280,611 B1 8/2001 Henkin et al.

(56) References Cited

U.S. PATENT DOCUMENTS

| | | | |
|---|---|---|---|
| 6,282,370 | B1 | 8/2001 | Cline et al. |
| 6,298,721 | B1 | 10/2001 | Schuppe et al. |
| 6,299,414 | B1 | 10/2001 | Schoenmeyr |
| 6,299,699 | B1 | 10/2001 | Porat et al. |
| 6,318,093 | B2 | 11/2001 | Gaudet et al. |
| 6,320,348 | B1 | 11/2001 | Kadah |
| 6,326,752 | B1 | 12/2001 | Jensen et al. |
| 6,329,784 | B1 | 12/2001 | Puppin |
| 6,330,525 | B1 | 12/2001 | Hays |
| 6,342,841 | B1 | 1/2002 | Stingl |
| 6,349,268 | B1 | 2/2002 | Ketonen et al. |
| 6,350,105 | B1 | 2/2002 | Kobayashi et al. |
| 6,351,359 | B1 | 2/2002 | Jager |
| 6,354,805 | B1 | 3/2002 | Moeller |
| 6,355,177 | B2 | 3/2002 | Senner et al. |
| 6,356,464 | B1 | 3/2002 | Balakrishnan |
| 6,356,853 | B1 | 3/2002 | Sullivan |
| 6,362,591 | B1 | 3/2002 | Moberg |
| 6,364,620 | B1 | 4/2002 | Fletcher et al. |
| 6,364,621 | B1 | 4/2002 | Yamauchi |
| 6,366,053 | B1 | 4/2002 | Belehradek |
| 6,366,481 | B1 | 4/2002 | Balakrishnan |
| 6,369,463 | B1 | 4/2002 | Maiorano |
| 6,373,204 | B1 | 4/2002 | Peterson |
| 6,373,728 | B1 | 4/2002 | Aarestrup |
| 6,374,854 | B1 | 4/2002 | Acosta |
| 6,375,430 | B1 | 4/2002 | Eckert et al. |
| 6,380,707 | B1 | 4/2002 | Rosholm |
| 6,388,642 | B1 | 5/2002 | Cotis |
| 6,390,781 | B1 | 5/2002 | McDonough |
| 6,406,265 | B1 | 6/2002 | Hahn |
| 6,407,469 | B1 | 6/2002 | Cline et al. |
| 6,411,481 | B1 | 6/2002 | Seubert |
| 6,415,808 | B2 | 7/2002 | Joshi |
| 6,416,295 | B1 | 7/2002 | Nagai |
| 6,426,633 | B1 | 7/2002 | Thybo |
| 6,443,715 | B1 | 9/2002 | Mayleben et al. |
| 6,445,565 | B1 | 9/2002 | Toyoda et al. |
| 6,447,446 | B1 | 9/2002 | Smith et al. |
| 6,448,713 | B1 | 9/2002 | Farkas et al. |
| 6,450,771 | B1 | 9/2002 | Centers |
| 6,462,971 | B1 | 10/2002 | Balakrishnan et al. |
| 6,464,464 | B2 | 10/2002 | Sabini |
| 6,468,042 | B2 | 10/2002 | Moller |
| 6,468,052 | B2 | 10/2002 | McKain et al. |
| 6,474,949 | B1 | 11/2002 | Arai |
| 6,475,180 | B2 | 11/2002 | Peterson et al. |
| 6,481,973 | B1 | 11/2002 | Struthers |
| 6,483,278 | B2 | 11/2002 | Harvest |
| 6,483,378 | B2 | 11/2002 | Blodgett |
| 6,490,920 | B1 | 12/2002 | Netzer |
| 6,493,227 | B2 | 12/2002 | Nielson et al. |
| 6,496,392 | B2 | 12/2002 | Odel |
| 6,499,961 | B1 | 12/2002 | Wyatt |
| 6,501,629 | B1 | 12/2002 | Mariott |
| 6,503,063 | B1 | 1/2003 | Brunsell |
| 6,504,338 | B1 | 1/2003 | Eichorn |
| 6,520,010 | B1 | 2/2003 | Bergveld |
| 6,522,034 | B1 | 2/2003 | Nakayama |
| 6,523,091 | B2 | 2/2003 | Tirumala |
| 6,527,518 | B2 | 3/2003 | Ostrowski |
| 6,534,940 | B2 | 3/2003 | Bell et al. |
| 6,534,947 | B2 | 3/2003 | Johnson |
| 6,537,032 | B1 | 3/2003 | Horiuchi |
| 6,538,908 | B2 | 3/2003 | Balakrishnan et al. |
| 6,539,797 | B2 | 4/2003 | Livingston |
| 6,543,940 | B2 | 4/2003 | Chu |
| 6,548,976 | B2 | 4/2003 | Jensen |
| 6,564,627 | B1 | 5/2003 | Sabini |
| 6,570,778 | B2 | 5/2003 | Lipo et al. |
| 6,571,807 | B2 | 6/2003 | Jones |
| 6,590,188 | B2 | 7/2003 | Cline |
| 6,591,697 | B2 | 7/2003 | Henyan |
| 6,591,863 | B2 | 7/2003 | Ruschell |
| 6,595,051 | B1 | 7/2003 | Chandler, Jr. |
| 6,595,762 | B2 | 7/2003 | Khanwilkar et al. |
| 6,604,909 | B2 | 8/2003 | Schoenmeyr |
| 6,607,360 | B2 | 8/2003 | Fong |
| 6,616,413 | B2 | 9/2003 | Humphries |
| 6,623,245 | B2 | 9/2003 | Meza et al. |
| 6,625,824 | B1 | 9/2003 | Lutz et al. |
| 6,626,840 | B2 | 9/2003 | Drzewiecki |
| 6,628,501 | B2 | 9/2003 | Toyoda |
| 6,632,072 | B2 | 10/2003 | Lipscomb et al. |
| 6,636,135 | B1 | 10/2003 | Vetter |
| 6,638,023 | B2 | 10/2003 | Scott |
| D482,664 | S | 11/2003 | Hunt |
| 6,643,153 | B2 | 11/2003 | Balakrishnan |
| 6,651,900 | B1 | 11/2003 | Yoshida |
| 6,655,922 | B1 | 12/2003 | Flek |
| 6,663,349 | B1 | 12/2003 | Discenzo et al. |
| 6,665,200 | B2 | 12/2003 | Goto |
| 6,672,147 | B1 | 1/2004 | Mazet |
| 6,675,912 | B2 | 1/2004 | Carrier |
| 6,676,382 | B2 | 1/2004 | Leighton et al. |
| 6,676,831 | B2 | 1/2004 | Wolfe |
| 6,687,141 | B2 | 2/2004 | Odell |
| 6,687,923 | B2 | 2/2004 | Dick |
| 6,690,250 | B2 | 2/2004 | Moller |
| 6,696,676 | B1 | 2/2004 | Graves et al. |
| 6,700,333 | B1 | 3/2004 | Hirshi et al. |
| 6,709,240 | B1 | 3/2004 | Schmalz |
| 6,709,241 | B2 | 3/2004 | Sabini |
| 6,709,575 | B1 | 3/2004 | Verdegan |
| 6,715,996 | B2 | 4/2004 | Moeller |
| 6,717,318 | B1 | 4/2004 | Mathiasssen |
| 6,732,387 | B1 | 5/2004 | Waldron |
| 6,737,905 | B1 | 5/2004 | Noda |
| D490,726 | S | 6/2004 | Eungprabhanth |
| 6,742,387 | B2 | 6/2004 | Hamamoto |
| 6,747,367 | B2 | 6/2004 | Cline et al. |
| 6,758,655 | B2 | 7/2004 | Sacher |
| 6,761,067 | B1 | 7/2004 | Capano |
| 6,768,279 | B1 | 7/2004 | Skinner |
| 6,770,043 | B1 | 8/2004 | Kahn |
| 6,774,664 | B2 | 8/2004 | Godbersen |
| 6,776,038 | B1 | 8/2004 | Horton et al. |
| 6,776,584 | B2 | 8/2004 | Sabini et al. |
| 6,778,868 | B2 | 8/2004 | Imamura et al. |
| 6,779,205 | B2 | 8/2004 | Mulvey |
| 6,779,950 | B1 | 8/2004 | Meier et al. |
| 6,782,309 | B2 | 8/2004 | Laflamme |
| 6,783,328 | B2 | 8/2004 | Lucke |
| 6,789,024 | B1 | 9/2004 | Kochan, Jr. et al. |
| 6,794,921 | B2 | 9/2004 | Abe |
| 6,797,164 | B2 | 9/2004 | Leaverton |
| 6,798,271 | B2 | 9/2004 | Swize |
| 6,799,950 | B2 | 10/2004 | Meier et al. |
| 6,806,677 | B2 | 10/2004 | Kelly et al. |
| 6,837,688 | B2 | 1/2005 | Kimberlin et al. |
| 6,842,117 | B2 | 1/2005 | Keown |
| 6,847,130 | B1 | 1/2005 | Belehradek et al. |
| 6,847,854 | B2 | 1/2005 | Discenzo |
| 6,854,479 | B2 | 2/2005 | Harwood |
| 6,863,502 | B2 | 3/2005 | Bishop et al. |
| 6,867,383 | B1 | 3/2005 | Currier |
| 6,875,961 | B1 | 4/2005 | Collins |
| 6,882,165 | B2 | 4/2005 | Ogura |
| 6,884,022 | B2 | 4/2005 | Albright |
| D504,900 | S | 5/2005 | Wang |
| D505,429 | S | 5/2005 | Wang |
| 6,888,537 | B2 | 5/2005 | Albright |
| 6,895,608 | B2 | 5/2005 | Goettl |
| 6,900,736 | B2 | 5/2005 | Crumb |
| 6,906,482 | B2 | 6/2005 | Shimizu |
| D507,243 | S | 7/2005 | Miller |
| 6,914,793 | B2 | 7/2005 | Balakrishnan |
| 6,922,348 | B2 | 7/2005 | Nakajima |
| 6,925,823 | B2 | 8/2005 | Lifson |
| 6,933,693 | B2 | 8/2005 | Schuchmann |
| 6,941,785 | B2 | 9/2005 | Haynes et al. |
| 6,943,325 | B2 | 9/2005 | Pittman |
| 6,973,794 | B2 | 9/2005 | Street |
| D511,530 | S | 11/2005 | Wang |

(56) References Cited

U.S. PATENT DOCUMENTS

D512,026 S 11/2005 Nurmi et al.
6,965,815 B1 11/2005 Tompkins et al.
6,966,967 B2 11/2005 Curry
D512,440 S 12/2005 Wang
6,973,974 B2 12/2005 McLoughlin et al.
6,976,052 B2 12/2005 Tompkins et al.
D513,737 S 1/2006 Riley
6,981,399 B1 1/2006 Nubp et al.
6,981,402 B2 1/2006 Bristol
6,984,158 B2 1/2006 Satoh
6,989,649 B2 1/2006 Melhorn
6,993,414 B2 1/2006 Shah
6,998,807 B2 2/2006 Phillips et al.
6,998,977 B2 2/2006 Gregori et al.
7,005,818 B2 2/2006 Jensen
7,012,394 B2 3/2006 Moore et al.
7,015,599 B2 3/2006 Gull et al.
7,040,107 B2 5/2006 Lee et al.
7,042,192 B2 5/2006 Mehlhorn
7,050,278 B2 5/2006 Poulsen
7,055,189 B2 6/2006 Goettl
7,070,134 B1 7/2006 Hoyer
7,077,781 B2 7/2006 Ishikawa
7,080,508 B2 7/2006 Stavale
7,081,728 B2 7/2006 Kemp
7,083,392 B2 8/2006 Meza
7,083,438 B2 8/2006 Massaro et al.
7,089,607 B2 8/2006 Barnes et al.
7,100,632 B2 9/2006 Harwood
7,102,505 B2 9/2006 Kates
7,107,184 B2 9/2006 Gentile et al.
7,112,037 B2 9/2006 Sabini et al.
7,114,926 B2 10/2006 Oshita
7,117,120 B2 10/2006 Beck et al.
7,141,210 B2 11/2006 Bell
7,142,932 B2 11/2006 Spria et al.
D533,512 S 12/2006 Nakashima
7,163,380 B2 1/2007 Jones
7,172,366 B1 2/2007 Bishop, Jr.
7,174,273 B2 2/2007 Goldberg
7,178,179 B2 2/2007 Barnes
7,183,741 B2 2/2007 Mehlhorn
7,195,462 B2 3/2007 Nybo et al.
7,201,563 B2 4/2007 Studebaker
7,221,121 B2 5/2007 Skaug
7,244,106 B2 7/2007 Kallaman
7,245,105 B2 7/2007 Joo
7,259,533 B2 8/2007 Yang et al.
7,264,449 B1 9/2007 Harned et al.
7,281,958 B2 10/2007 Schuttler et al.
7,292,898 B2 11/2007 Clark et al.
7,307,538 B2 12/2007 Kochan, Jr.
7,309,216 B1 12/2007 Spadola et al.
7,318,344 B2 1/2008 Heger
D562,349 S 2/2008 Bulter
7,327,275 B2 2/2008 Brochu
7,339,126 B1 3/2008 Niedermeyer
D567,189 S 4/2008 Stiles, Jr.
7,352,550 B2 4/2008 Mladenik
7,375,940 B1 5/2008 Bertrand
7,388,348 B2 6/2008 Mattichak
7,407,371 B2 8/2008 Leone
7,427,844 B2 9/2008 Mehlhorn
7,429,842 B2 9/2008 Schulman et al.
7,437,215 B2 10/2008 Anderson et al.
D582,797 S 12/2008 Fraser
D583,828 S 12/2008 Li
7,458,782 B1 12/2008 Spadola et al.
7,459,886 B1 12/2008 Potanin et al.
7,484,938 B2 2/2009 Allen
7,516,106 B2 4/2009 Ehlers
7,517,351 B2 4/2009 Culp et al.
7,525,280 B2 4/2009 Fagan et al.
7,528,579 B2 5/2009 Pacholok et al.
7,542,251 B2 6/2009 Ivankovic
7,542,252 B2 6/2009 Chan et al.
7,572,108 B2 8/2009 Koehl
7,612,510 B2 11/2009 Koehl
7,612,529 B2 11/2009 Kochan, Jr.
7,623,986 B2 11/2009 Miller
7,641,449 B2 1/2010 Iimura et al.
7,652,441 B2 1/2010 Ho
7,686,587 B2 3/2010 Koehl
7,686,589 B2 3/2010 Stiles et al.
7,690,897 B2 4/2010 Branecky
7,700,887 B2 4/2010 Niedermeyer
7,704,051 B2 4/2010 Koehl
7,707,125 B2 4/2010 Haji-Valizadeh
7,727,181 B2 6/2010 Rush
7,739,733 B2 6/2010 Szydlo
7,746,063 B2 6/2010 Sabini et al.
7,751,159 B2 7/2010 Koehl
7,753,880 B2 7/2010 Malackowski
7,755,318 B1 7/2010 Panosh
7,775,327 B2 8/2010 Abraham
7,777,435 B2 8/2010 Aguilar
7,788,877 B2 9/2010 Andras
7,795,824 B2 9/2010 Shen et al.
7,808,211 B2 10/2010 Pacholok et al.
7,815,420 B2 10/2010 Koehl
7,821,215 B2 10/2010 Koehl
7,845,913 B2 12/2010 Stiles et al.
7,854,597 B2 12/2010 Stiles et al.
7,857,600 B2 12/2010 Koehl
7,874,808 B2 1/2011 Stiles
7,878,766 B2 2/2011 Meza
7,900,308 B2 3/2011 Erlich
7,925,385 B2 4/2011 Stavale et al.
7,931,447 B2 4/2011 Levin et al.
7,945,411 B2 5/2011 Kernan et al.
7,976,284 B2 7/2011 Koehl
7,983,877 B2 7/2011 Koehl
7,990,091 B2 8/2011 Koehl
8,007,255 B2 8/2011 Hattori et al.
8,011,895 B2 9/2011 Ruffo
8,019,479 B2 9/2011 Stiles
8,032,256 B1 10/2011 Wolf et al.
8,043,070 B2 10/2011 Stiles
8,049,464 B2 11/2011 Muntermann
8,098,048 B2 1/2012 Hoff
8,104,110 B2 1/2012 Caudill et al.
8,126,574 B2 2/2012 Discenzo et al.
8,133,034 B2 3/2012 Mehlhorn et al.
8,134,336 B2 3/2012 Michalske et al.
8,164,470 B2 4/2012 Brochu et al.
8,177,520 B2 5/2012 Mehlhorn
8,281,425 B2 10/2012 Cohen
8,299,662 B2 10/2012 Schmidt et al.
8,303,260 B2 11/2012 Stavale et al.
8,313,306 B2 11/2012 Stiles et al.
8,316,152 B2 11/2012 Geltner et al.
8,317,485 B2 11/2012 Meza et al.
8,337,166 B2 12/2012 Meza et al.
8,380,355 B2 2/2013 Mayleben et al.
8,405,346 B2 3/2013 Trigiani
8,405,361 B2 3/2013 Richards et al.
8,444,394 B2 5/2013 Koehl
8,465,262 B2 6/2013 Stiles et al.
8,469,675 B2 6/2013 Stiles et al.
8,480,373 B2 7/2013 Stiles et al.
8,500,413 B2 8/2013 Stiles et al.
8,540,493 B2 9/2013 Koehl
8,547,065 B2 10/2013 Trigiani
8,573,952 B2 11/2013 Stiles et al.
8,579,600 B2 11/2013 Vijayakumar
8,602,745 B2 12/2013 Stiles
8,641,383 B2 2/2014 Meza
8,641,385 B2 2/2014 Koehl
8,669,494 B2 3/2014 Tran
8,756,991 B2 6/2014 Edwards
8,763,315 B2 7/2014 Hartman
8,774,972 B2 7/2014 Rusnak
8,801,389 B2 8/2014 Stiles, Jr. et al.
8,981,684 B2 3/2015 Drye et al.

(56) References Cited

U.S. PATENT DOCUMENTS 9,030,066 B2 5/2015 Drye
9,051,930 B2 6/2015 Stiles, Jr. et al.
9,238,918 B2 1/2016 McKinzie
9,822,782 B2 11/2017 McKinzie
2001/0002238 A1 5/2001 McKain
2001/0029407 A1 10/2001 Tompkins
2001/0041139 A1 11/2001 Sabini et al.
2002/0000789 A1 1/2002 Haba
2002/0002989 A1 1/2002 Jones
2002/0010839 A1 1/2002 Tirumala et al.
2002/0018721 A1 2/2002 Kobayashi
2002/0032491 A1 3/2002 Imamura et al.
2002/0035403 A1 3/2002 Clark et al.
2002/0050490 A1 5/2002 Pittman et al.
2002/0070611 A1 6/2002 Cline et al.
2002/0070875 A1 6/2002 Crumb
2002/0076330 A1 6/2002 Lipscomb et al.
2002/0082727 A1 6/2002 Laflamme et al.
2002/0089236 A1 7/2002 Cline et al.
2002/0093306 A1 7/2002 Johnson
2002/0101193 A1 8/2002 Farkas
2002/0111554 A1 8/2002 Drzewiecki
2002/0131866 A1 9/2002 Phillips
2002/0136642 A1 9/2002 Moller
2002/0143478 A1 10/2002 Vanderah et al.
2002/0150476 A1 10/2002 Lucke
2002/0163821 A1 11/2002 Odell
2002/0172055 A1 11/2002 Balakrishnan
2002/0176783 A1 11/2002 Moeller
2002/0190687 A1 12/2002 Bell et al.
2003/0000303 A1 1/2003 Livingston
2003/0017055 A1 1/2003 Fong
2003/0030954 A1 2/2003 Bax et al.
2003/0034284 A1* 2/2003 Wolfe ..... 210/85
2003/0034761 A1 2/2003 Goto
2003/0048646 A1 3/2003 Odell
2003/0049134 A1 3/2003 Leighton et al.
2003/0063900 A1 4/2003 Wang et al.
2003/0099548 A1 5/2003 Meza
2003/0106147 A1 6/2003 Cohen et al.
2003/0061004 A1 7/2003 Discenzo
2003/0138327 A1 7/2003 Jones et al.
2003/0174450 A1 9/2003 Nakajima et al.
2003/0186453 A1 10/2003 Bell
2003/0196942 A1* 10/2003 Jones ..... 210/169
2004/0000525 A1 1/2004 Hornsby
2004/0006486 A1 1/2004 Schmidt et al.
2004/0009075 A1 1/2004 Meza
2004/0013531 A1 1/2004 Curry et al.
2004/0016241 A1 1/2004 Street et al.
2004/0025244 A1 2/2004 Lloyd et al.
2004/0055363 A1 3/2004 Bristol
2004/0062658 A1 4/2004 Beck et al.
2004/0064292 A1 4/2004 Beck
2004/0071001 A1 4/2004 Balakrishnan
2004/0080325 A1 4/2004 Ogura
2004/0080352 A1 4/2004 Noda
2004/0090197 A1 5/2004 Schuchmann
2004/0095183 A1 5/2004 Swize
2004/0116241 A1 6/2004 Ishikawa
2004/0117330 A1 6/2004 Ehlers et al.
2004/0118203 A1 6/2004 Heger
2004/0149666 A1 8/2004 Ehlers et al.
2004/0205886 A1 10/2004 Goettel
2004/0213676 A1 10/2004 Phillips
2004/0261167 A1 12/2004 Panopoulos
2004/0265134 A1 12/2004 Iimura et al.
2005/0050908 A1 3/2005 Lee et al.
2005/0058548 A1 3/2005 Thomas et al.
2005/0086957 A1 4/2005 Lifson
2005/0092946 A1 5/2005 Fellington et al.
2005/0095150 A1 5/2005 Leone et al.
2005/0097665 A1 5/2005 Goettel
2005/0123408 A1 6/2005 Koehl
2005/0133088 A1 6/2005 Bologeorges
2005/0137720 A1 6/2005 Spira et al.
2005/0156568 A1 7/2005 Yueh
2005/0158177 A1 7/2005 Mehlhorn
2005/0162787 A1 7/2005 Weigel
2005/0167345 A1 8/2005 De Wet et al.
2005/0168900 A1* 8/2005 Brochu ..... G05B 23/0235 361/93.1
2005/0170936 A1 8/2005 Quinn
2005/0180868 A1 8/2005 Miller
2005/0190094 A1 9/2005 Andersen
2005/0193485 A1 9/2005 Wolfe
2005/0195545 A1 9/2005 Mladenik
2005/0226731 A1* 10/2005 Mehlhorn et al. ..... 417/44.11
2005/0235732 A1 10/2005 Rush
2005/0248310 A1 11/2005 Fagan et al.
2005/0260079 A1 11/2005 Allen
2005/0281679 A1 12/2005 Niedermeyer
2005/0281681 A1 12/2005 Anderson
2006/0045750 A1 3/2006 Stiles
2006/0045751 A1 3/2006 Beckman et al.
2006/0078435 A1 4/2006 Burza
2006/0078444 A1 4/2006 Sacher
2006/0090255 A1 5/2006 Cohen
2006/0093492 A1 5/2006 Janesky
2006/0106503 A1 5/2006 Lamb et al.
2006/0127227 A1 6/2006 Mehlhorn
2006/0138033 A1 6/2006 Hoal et al.
2006/0146462 A1 7/2006 McMillian et al.
2006/0162787 A1 7/2006 Yeh
2006/0169322 A1 8/2006 Torkelson
2006/0201555 A1 9/2006 Harnza
2006/0204367 A1 9/2006 Meza
2006/0226997 A1 10/2006 Kochan, Jr.
2006/0235573 A1 10/2006 Guion
2006/0269426 A1 11/2006 Llewellyn
2007/0001635 A1 1/2007 Ho
2007/0041845 A1 2/2007 Freudenberger
2007/0061051 A1 3/2007 Maddox
2007/0080660 A1 4/2007 Fagan et al.
2007/0113647 A1 5/2007 Mehlhorn
2007/0114162 A1 5/2007 Stiles et al.
2007/0124321 A1 5/2007 Szydlo
2007/0154319 A1 7/2007 Stiles
2007/0154320 A1 7/2007 Stiles
2007/0154321 A1 7/2007 Stiles
2007/0154322 A1 7/2007 Stiles
2007/0154323 A1 7/2007 Stiles
2007/0160480 A1 7/2007 Ruffo
2007/0163929 A1 7/2007 Stiles
2007/0177985 A1 8/2007 Walls et al.
2007/0183902 A1 8/2007 Stiles
2007/0187185 A1 8/2007 Abraham et al.
2007/0188129 A1 8/2007 Kochan, Jr.
2007/0212210 A1 9/2007 Kennan et al.
2007/0212229 A1 9/2007 Stavale et al.
2007/0212230 A1 9/2007 Stavale et al.
2007/0219652 A1 9/2007 McMillan
2007/0258827 A1 11/2007 Gierke
2008/0003114 A1 1/2008 Levin et al.
2008/0031751 A1 2/2008 Littwin et al.
2008/0031752 A1 2/2008 Littwin et al.
2008/0039977 A1 2/2008 Clark et al.
2008/0041839 A1 2/2008 Tran
2008/0044293 A1 2/2008 Hanke et al.
2008/0063535 A1 3/2008 Koehl
2008/0095638 A1 4/2008 Branecky
2008/0095639 A1 4/2008 Bartos
2008/0131286 A1 6/2008 Ota
2008/0131289 A1 6/2008 Koehl
2008/0131291 A1 6/2008 Koehl
2008/0131294 A1 6/2008 Koehl
2008/0131295 A1 6/2008 Koehl
2008/0131296 A1 6/2008 Koehl
2008/0140353 A1 6/2008 Koehl
2008/0152508 A1 6/2008 Meza
2008/0168599 A1 7/2008 Caudill
2008/0181785 A1 7/2008 Koehl
2008/0181786 A1 7/2008 Meza
2008/0181787 A1 7/2008 Koehl

(56) References Cited

U.S. PATENT DOCUMENTS

| | | | |
|---|---|---|---|
| 2008/0181788 | A1 | 7/2008 | Meza |
| 2008/0181789 | A1 | 7/2008 | Koehl |
| 2008/0181790 | A1 | 7/2008 | Meza |
| 2008/0189885 | A1 | 8/2008 | Erlich |
| 2008/0229819 | A1 | 9/2008 | Mayleben et al. |
| 2008/0260540 | A1 | 10/2008 | Koehl |
| 2008/0288115 | A1 | 11/2008 | Rusnak et al. |
| 2008/0298978 | A1 | 12/2008 | Schulman et al. |
| 2009/0014044 | A1 | 1/2009 | Hartman |
| 2009/0038696 | A1 | 2/2009 | Levin et al. |
| 2009/0052281 | A1 | 2/2009 | Nybo |
| 2009/0104044 | A1 | 4/2009 | Koehl |
| 2009/0143917 | A1 | 6/2009 | Uy et al. |
| 2009/0204237 | A1 | 8/2009 | Sustaeta et al. |
| 2009/0204267 | A1 | 8/2009 | Sustaeta et al. |
| 2009/0208345 | A1 | 8/2009 | Moore et al. |
| 2009/0210081 | A1 | 8/2009 | Sustaeta et al. |
| 2009/0269217 | A1 | 10/2009 | Vijayakumar |
| 2009/0290991 | A1 | 11/2009 | Mehlhorn et al. |
| 2010/0079096 | A1 | 4/2010 | Braun et al. |
| 2010/0154534 | A1 | 6/2010 | Hampton |
| 2010/0166570 | A1 | 7/2010 | Hampton |
| 2010/0197364 | A1 | 8/2010 | Lee |
| 2010/0303654 | A1 | 12/2010 | Petersen et al. |
| 2010/0306001 | A1 | 12/2010 | Discenzo |
| 2010/0312398 | A1 | 12/2010 | Kidd et al. |
| 2011/0036164 | A1 | 2/2011 | Burdi |
| 2011/0044823 | A1 | 2/2011 | Stiles |
| 2011/0052416 | A1 | 3/2011 | Stiles |
| 2011/0061415 | A1 | 3/2011 | Ward |
| 2011/0066256 | A1 | 3/2011 | Sesay et al. |
| 2011/0077875 | A1 | 3/2011 | Tran |
| 2011/0084650 | A1 | 4/2011 | Kaiser et al. |
| 2011/0110794 | A1 | 5/2011 | Mayleben et al. |
| 2011/0280744 | A1 | 11/2011 | Ortiz et al. |
| 2011/0311370 | A1 | 12/2011 | Sloss et al. |
| 2012/0013285 | A1 | 1/2012 | Kasunich et al. |
| 2012/0020810 | A1 | 1/2012 | Stiles, Jr. et al. |
| 2012/0100010 | A1 | 4/2012 | Stiles et al. |
| 2013/0106217 | A1 | 5/2013 | Drye |
| 2013/0106321 | A1 | 5/2013 | Drye et al. |
| 2013/0106322 | A1 | 5/2013 | Drye |
| 2014/0018961 | A1 | 1/2014 | Guzelgunler |
| 2014/0372164 | A1 | 12/2014 | Egan et al. |

FOREIGN PATENT DOCUMENTS

| | | | |
|---|---|---|---|
| AU | 2007332716 | A1 | 6/2008 |
| AU | 2007332769 | A1 | 6/2008 |
| CA | 2548437 | A1 | 6/2005 |
| CA | 2731482 | A1 | 6/2005 |
| CA | 2517040 | A1 | 2/2006 |
| CA | 2528580 | A1 | 5/2007 |
| CA | 2672410 | A1 | 6/2008 |
| CA | 2672459 | A1 | 6/2008 |
| CN | 1821574 | A | 8/2006 |
| CN | 101165352 | | 4/2008 |
| DE | 3023463 | A1 | 2/1981 |
| DE | 2946049 | A1 | 5/1981 |
| DE | 29612980 | U1 | 10/1996 |
| DE | 19736079 | A1 | 8/1997 |
| DE | 19645129 | A1 | 5/1998 |
| DE | 29724347 | U1 | 11/2000 |
| DE | 10231773 | A1 | 2/2004 |
| DE | 19938490 | B4 | 4/2005 |
| EP | 0150068 | A2 | 7/1985 |
| EP | 0226858 | A1 | 7/1987 |
| EP | 0246769 | A2 | 11/1987 |
| EP | 0306814 | A1 | 3/1989 |
| EP | 0314249 | A1 | 3/1989 |
| EP | 0709575 | A1 | 5/1996 |
| EP | 0735273 | A1 | 10/1996 |
| EP | 0833436 | A2 | 4/1998 |
| EP | 0831188 | A3 | 2/1999 |
| EP | 0978657 | A1 | 2/2000 |
| EP | 1112680 | A2 | 4/2001 |
| EP | 1134421 | A1 | 9/2001 |
| EP | 0916026 | | 5/2002 |
| EP | 1315929 | | 6/2003 |
| EP | 1429034 | A2 | 6/2004 |
| EP | 1585205 | A2 | 10/2005 |
| EP | 1630422 | A2 | 3/2006 |
| EP | 1698815 | A1 | 9/2006 |
| EP | 1790858 | A1 | 5/2007 |
| EP | 1995462 | A2 | 11/2008 |
| EP | 2102503 | A2 | 9/2009 |
| EP | 2122171 | A1 | 11/2009 |
| EP | 2122172 | A1 | 11/2009 |
| EP | 2273125 | A1 | 1/2011 |
| FR | 2529965 | A1 | 1/1984 |
| FR | 2703409 | A1 | 10/1994 |
| GB | 2124304 | A1 | 2/1984 |
| JP | 55072678 | A | 5/1980 |
| JP | 5010270 | A | 1/1993 |
| MX | 2009006258 | A1 | 12/2009 |
| WO | 98/04835 | A1 | 2/1998 |
| WO | 00/42339 | A1 | 7/2000 |
| WO | 01/27508 | A1 | 4/2001 |
| WO | 01/47099 | A1 | 6/2001 |
| WO | 02/018826 | A1 | 3/2002 |
| WO | 03/025442 | A1 | 3/2003 |
| WO | 03/099705 | A2 | 12/2003 |
| WO | 2004/006416 | A1 | 1/2004 |
| WO | 2004/073772 | A1 | 9/2004 |
| WO | 2004/088694 | A1 | 10/2004 |
| WO | 05/011473 | A1 | 2/2005 |
| WO | 2005011473 | A3 | 2/2005 |
| WO | 2005/055694 | A1 | 6/2005 |
| WO | 2005111473 | A2 | 11/2005 |
| WO | 2006/069568 | A1 | 7/2006 |
| WO | 2008/073329 | A1 | 6/2008 |
| WO | 2008/073330 | A1 | 6/2008 |
| WO | 2008073386 | A1 | 6/2008 |
| WO | 2008073413 | A1 | 6/2008 |
| WO | 2008073418 | A1 | 6/2008 |
| WO | 2008073433 | A1 | 6/2008 |
| WO | 2008073436 | A1 | 6/2008 |
| WO | 2011/100067 | A1 | 8/2011 |
| WO | 2014152926 | A1 | 9/2014 |
| ZA | 200506869 | | 5/2006 |
| ZA | 200509691 | | 11/2006 |
| ZA | 200904747 | | 7/2010 |
| ZA | 200904849 | | 7/2010 |
| ZA | 200904850 | | 7/2010 |

OTHER PUBLICATIONS

U.S. Appl. No. 12/869,570 Appeal Decision dated May 24, 2016.

Bibliographic Data Sheet—U.S. Appl. No. 10/730,747 Applicant: Robert M. Koehl Reasons for Inclusion: Printed publication US 200510123408 A1 for U.S. Appl. No. 10/730,747 has incorrect filing date.

Shabnam Moghanrabi; "Better, Stronger, Faster;" Pool & Spa News, Sep. 3, 2004; pp. 1-5; www/poolspanews.com.

Grundfos Pumps Corporation; "The New Standard in Submersible Pumps;" Brochure; pp. 1-8; Jun. 1999; Fresno, CA USA.

Grundfos Pumps Corporation; "Grundfos SQ/SQE Data Book;" pp. 1-39; Jun. 1999; Fresno, CA USA.

Goulds Pumps; "Balanced Flow System Brochure;" pp. 1-4; 2001.

Goulds Pumps; "Balanced Flow Submersible System Installation, Operation & Trouble-Shooting Manual;" pp. 1-9; 2000; USA.

Goulds Pumps; "Balanced Flow Submersible System Informational Seminar;" pp. 1-22; Undated.

Goulds Pumps; "Balanced Flow System Variable Speed Submersible Pump" Specification Sheet; pp. 1-2; Jan. 2000; USA.

Goulds Pumps; Advertisement from "Pumps & Systems Magazine;" entitled "Cost Effective Pump Protection+ Energy Savings," Jan. 2002; Seneca Falls, NY.

Goulds Pumps; "Hydro-Pro Water System Tank Installation, Operation & Maintenance Instructions;" pp. 1-30; Mar. 31, 2001; Seneca Falls, NY USA.

(56) References Cited

OTHER PUBLICATIONS

Goulds Pumps; "Pumpsmart Control Solutions" Advertisement from Industrial Equipment News; Aug. 2002; New York, NY USA.
Goulds Pumps; "Model BFSS List Price Sheet;" Feb. 5, 2001.
Goulds Pumps; "Balanced Flow System Model BFSS Variable Speed Submersible Pump System" Brochure; pp. 1-4; Jan 2001; USA.
Goulds Pumps; "Balanced Flow System Model BFSS Variable Speed Submersible Pump" Brochure; pp. 1-3; Jan. 2000; USA.
Goulds Pumps; "Balanced Flow System . . . The Future of Constant Pressure Has Arrived;" Undated Advertisement.
AMTROL Inc.; "AMTROL Unearths the Facts About Variable Speed Pumps and Constant Pressure Valves;" pp. 1-5; Mar. 2002; West Warwick, RI USA.
Franklin Electric; "CP Water-Subdrive 75 Constant Pressure Controller" Product Data Sheet; May 2001; Bluffton, IN USA.
Franklin Electric; "Franklin Aid, Subdrive 75: You Made It Better;" vol. 20, No. 1; pp. 1-2; Jan./Feb. 2002; www.franklin-electric.com.
Grundfos; "SQ/SQE—A New Standard in Submersible Pumps;" Undated Brochure; pp. 1-14; Denmark.
Grundfos; "JetPaq—The Complete Pumping System;" Undated Brochure; pp. 1-4; Clovis, CA USA.
Email Regarding Grundfos' Price Increases/SQ/SQE Curves; pp. 1-7; Dec. 19, 2001.
F.E. Myers; "Featured Product: F.E. Myers Introducts Revolutionary Constant Pressure Water System;" pp. 1-8; Jun. 28, 2000; Ashland, OH USA.
"Water Pressure Problems" Published Article; The American Well Owner; No. 2, Jul. 2000.
Bjarke Soerensen; "Have You Chatted With Your Pump Today?" Undated Article Reprinted with Permission of Grundfos Pump University; pp. 1-2; USA.
"Understanding Constant Pressure Control;" pp. 1-3; Nov. 1, 1999.
"Constant Pressure is the Name of the Game;" Published Article from National Driller; Mar. 2001.
SJE-Rhombus; "Variable Frequency Drives for Constant Pressure Control;" Aug. 2008; pp. 1-4; Detroit Lakes, MN USA.
SJE-Rhombus; "Constant Pressure Controller for Submersible Well Pumps;" Jan. 2009; pp. 1-4; Detroit Lakes, MN USA.
SJE-Rhombus; "SubCon Variable Frequency Drive;" Dec. 2008; pp. 1-2; Detroit Lakes, MN USA.
Grundfos; "SmartFio SQE Constant Pressure System;" Mar. 2002; pp. 1-4; Olathe, KS USA.
Grundfos; "Grundfos SmartFio SQE Constant Pressure System;" Mar. 2003; pp. 1-2; USA.
Grundfos; "Uncomplicated Electronics . . . Advanced Design;" pp. 1-10; Undated.
Grundfos; "CU301 Installation & Operation Manual;" Apr. 2009; pp. 1-2; Undated; www.grundfos.com.
Grundfos; "CU301 Installation & Operating Instructions;" Sep. 2005; pp. 1-30; Olathe, KS USA.
ITT Corporation; "Goulds Pumps Balanced Flow Submersible Pump Controller;" Jul. 2007; pp. 1-12.
ITT Corporation; "Goulds Pumps Balanced Flow;" Jul. 2006; pp. 1-8.
ITT Corporation; "Goulds Pumps Balanced Flow Constant Pressure Controller for 2 HP Submersible Pumps;" Jun. 2005; pp. 1-4 USA.
ITT Corporation; "Goulds Pumps Balanced Flow Constant Pressure Controller for 3 HP Submersible Pumps;" Jun. 2005; pp. 1-4; USA.
Franklin Electric; Constant Pressure in Just the Right Size; Aug. 2006; pp. 1-4; Bluffton, IN USA.
Franklin Electric; "Franklin Application Installation Data;" vol. 21, No. 5, Sep./Oct. 2003; pp. 1-2; www.franklin-electric.com.
Franklin Electric; "Monodrive MonodriveXT Single-Phase Constant Pressure;" Sep. 2008; pp. 1-2; Bluffton, IN USA.
Docket Report for Case No. 5:11-cv-00459-D; Nov. 2012.
1—Complaint Filed by Pentair Water Pool & Spa, Inc. and Danfoss Drives A/S with respect to Civil Action No. 5:11-cv-00459-D; Aug. 31, 2011.
7—Motion for Preliminary Injunction by Danfoss Drives AIS & Pentair Water Pool & Spa, Inc. with respect to Civil Action No. 5:11-cv-00459-D; Sep. 30, 2011.
22—Memorandum in Support of Motion for Preliminary Injunction by Plaintiffs with respect to Civil Action 5:11-cv-00459-D; Sep. 2, 2011.
23—Declaration of E. Randolph Collins, Jr. in Support of Motion for Preliminary Injunction with respect to Civil Action 5:11-cv-00459-D; Sep. 30, 2011.
24—Declaration of Zack Picard in Support of Motion for Preliminary Injunction with respect to Civil Action 5:11-cv-00459-D; Sep. 30, 2011.
32—Answer to Complaint with Jury Demand & Counterclaim Against Plaintiffs by Hayward Pool Products & Hayward Industries for Civil Action 5:11-cv-004590; Oct. 12, 2011.
USPTO Patent Trial and Appeal Board, Paper 47—Final Written Decision, Case IPR2013-00285, U.S. Pat. No. 5,019,479 B2, Nov. 19, 2014, 39 pages.
Pentair Pool Products, WhisperFlo Pump Owner's Manual, Jun. 5, 2001, 10 pages.
Allen-Bradley; "1336 Plus II Adjustable Frequency AC Drive with Sensorless Vector User Manual;" Sep. 2005; pp. 1-212.
USPTO Patent Board Decision—Examiner Reversed; Appeal No. 2015-007909 re: U.S. Pat. No. 7,686,587B2; dated Apr. 1, 2016.
USPTO Patent Board Decision—Examiner Affirmed in Part; Appeal No. 2016-002780 re: U.S. Pat. No. 7,854,597B2; dated Aug. 30, 2016.
USPTO Patent Board Decision—Decision on Reconsideration, Denied; Appeal No. 2015-007909 re: U.S. Pat. No. 7,686,587B2; dated Aug. 30, 2016.
Flotec Owners Manual, dated 2004. 44 pages.
Glentronics Home Page, dated 2007. 2 pages.
Goulds Pumps SPBB Battery Back-Up Pump Brochure, dated 2008. 2 pages.
Goulds Pumps SPBBISPBB2 Battery Backup Sump Pumps, dated 2007.
ITT Red Jacket Water Products Installation, Operation and Parts Manual, dated 2009. 8 pages.
Liberty Pumps PC-Series Brochure, dated 2010. 2 pages.
"Lift Station Level Control" by Joe Evans PhD, www.pumped101.com, dated Sep. 2007. 5 pages.
The Basement Watchdog A/C-D/C Battery Backup Sump Pump System Instruction Manual and Safety Warnings, dated 2010. 20 pages.
The Basement Watchdog Computer Controlled A/C-D/C Sump Pump System Instruction Manual, dated 2010. 17 pages.
Pentair Water Ace Pump Catalog, dated 2007, 44 pages.
ITT Red Jacket Water Products RJBB/RJBB2 Battery Backup Sump Pumps; May 2007, 2 pages.
51—Response by Defendants in Opposition to Motion for Preliminary Injunction for Civil Action 5:11-cv-00459D; Dec. 2, 2011.
Amended Complaint Filed by Pentair Water Pool & Spa, Inc. and Danfoss Drives A/S with respect to Civil Action No. 5:11-cv-00459, adding U.S. Pat. No. 8,043,070.
53—Declaration of Douglas C. Hopkins & Exhibits re Response Opposing Motion for Preliminary Injunction for Civil Action 5:11-cv-00459D; Dec. 2, 2011.
89—Reply to Response to Motion for Preliminary Injunction Filed by Danfoss Drives A/S & Pentair Water Pool & Spa, Inc. for Civil Action 5:11-cv-004590; Jan. 3, 2012.
105—Declaration re Memorandum in Opposition, Declaration of Lars Hoffmann Berthelsen for Civil Action 5:11-cv-00459D; Jan. 11, 2012.
112—Amended Complaint Against All Defendants, with Exhibits for Civil Action 5:11-cv-00459D; Jan. 17, 2012.
119—0rder Denying Motion for Preliminary Injunction for Civil Action 5:11-cv-00459D; Jan. 23, 2012.
123—Answer to Amended Complaint, Counterclaim Against Danfoss Drives A/S, Pentair Water Pool & Spa, Inc. for Civil Action 5:11-cv-00459D; Jan. 27, 2012.
152—0rder Denying Motion for Reconsideration for Civil Action 5:11-cv-00459D; Apr. 4, 2012.

(56) References Cited

OTHER PUBLICATIONS

168—Amended Motion to Stay Action Pending Reexamination of Asserted Patents by Defendants for Civil Action 5:11-cv-004590; Jun. 13, 2012.
174—Notice and Attachments re Joint Claim Construction Statement for Civil Action 5:11-cv-00459D; Jun. 5, 2012.
186—Order Setting Hearings—Notice of Markman Hearing Set for Oct. 17, 2012 for Civil Action 5:11-cv-00459D; Jul. 12, 2012.
204—Response by Plaintiffs Opposing Amended Motion to Stay Action Pending Reexamination of Asserted Patents for Civil Action 5:11-cv-004590; Jul. 2012.
210—Order Granting Joint Motion for Leave to Enlarge Page Limit for Civil Action 5:11-cv-004590; Jul. 2012.
218—Notice re Plaintiffs re Order on Motion for Leave to File Excess pp. re Amended Joint Claim Construction Statement for Civil Action 5:11-cv-004590; Aug. 2012.
54DX16—Hayward EcoStar Technical Guide (Version2); 2011; pp. 1-51; cited in Civil Action 5:11-cv-004590.
54DX17—Hayward ProLogic Automation & Chlorination Operation Manual (Rev. F); pp. 1-27; Elizabeth, NJ; cited in Civil Action 5:11-cv-004590; Dec. 2, 2011.
54DX18—Stmicroelectronics; "AN1946—Sensorless BLOC Motor Control & BEMF Sampling Methods with ST7MC;" 2007; pp. 1-35; Civil Action 5:11-cv-004590.
54DX19—Stmicroelectronics; "AN1276 BLOC Motor Start Routine for ST72141 Microcontroller;" 2000; pp. 1-18; cited in Civil Action 5:11-cv-004590.
54DX21—Danfoss; "VLT 8000 Aqua Instruction Manual;" Apr. 2004; 1-210; Cited in Civil Action 5:11-cv-004590.
54DX22—Danfoss; "VLT 8000 Aqua Instruction Manual;" pp. 1-35; cited in Civil Action 5:11-cv-004590; Dec. 2, 2011.
54DX23—Commander; "Commander SE Advanced User Guide;" Nov. 2002; pp. 1-190; cited in Civil Action 5:11-cv-004590.
540X30—Sabbagh et al.; "A Model for Optimal Control of Pumping Stations in Irrigation Systems;" Jul. 1988; NL pp. 119-133; Civil Action 5:11-cv-004590.
540X31—0ANFOSS; "VLT 5000 FLUX Aqua OeviceNet Instruction Manual;" Apr. 28, 2003; pp. 1-39; cited in Civil Action 5:11-cv-004590.
540X32—0ANFOSS; "VLT 5000 FLUX Aqua Profibus Operating Instructions;" May 22, 2003; 1-64; cited in Civil Action 5:11-cv-004590.
540X33—Pentair; "IntelliTouch Owner's Manual Set-Up & Programming;" May 22, 2003; Sanford, NC; pp. 1-61; cited in Civil Action 5:11-cv-004590.
540X34—Pentair; "Compoo13800 Pool-Spa Control System Installation & Operating Instructions;" Nov. 7, 1997; pp. 1-45; cited in Civil Action 5:11-cv-004590.
540X35—Pentair Advertisement in "Pool & Spa News;" Mar. 22, 2002; pp. 1-3; cited in Civil Action 5:11-cv-004590.
5540X36—Hayward; "Pro-Series High-Rate Sand Filter Owner's Guide;" 2002; Elizabeth, NJ; pp. 1-5; cited in Civil Action 5:11-cv-00459D.
540X37—Danfoss; "VLT 8000 Aqua Fact Sheet;" Jan. 2002; pp. 1-3; cited in Civil Action 5:11-cv-004590.
540X38—0ANFOSS; "VLT 6000 Series Installation, Operation & Maintenance Manual;" Mar. 2000; pp. 1-118; cited in civil Action 5:11-cv-004590.
540X45—Hopkins; "Synthesis of New Class of Converters that Utilize Energy Recirculation;" pp. 1-7; cited in Civil Action 5:11-cv-004590; 1994.
540X46—Hopkins; "High-Temperature, High-Oensity . . . Embedded Operation;" pp. 1-8; cited in Civil Action 5:11-cv-004590; Mar. 2006.
540X47—Hopkins; "Optimally Selecting Packaging Technologies . . . Cost & Performance;" pp. 1-9; cited in Civil Action 5:11-cv-004590; Jun. 1999.
9PX5—Pentair; Selected Website Pages; pp. 1-29; cited in Civil Action 5:11-cv-004590; Sep. 2011.
9PX6—Pentair; "IntelliFio Variable Speed Pump" Brochure; 2011; pp. 1-9; cited in Civil Action 5:11-cv-004590.
9PX7—Pentair; "IntelliFio VF Intelligent Variable Flow Pump;" 2011; pp. 1-9; cited in Civil Action 5:11-cv-004590.
9PX8—Pentair; "IntelliFio VS+SVRS Intelligent Variable Speed Pump;" 2011; pp. 1-9; cited in Civil Action 5:11-cv-004590.
9PX9—Sta-Rite; "IntelliPro Variable Speed Pump;" 2011; pp. 1-9; cited in Civil Action 5:11-cv-004590.
9PX14—Pentair; "IntelliFio Installation and User's Guide;" pp. 1-53; Jul. 26, 2011; Sanford, NC; cited in Civil Action 5:11-cv-004590.
9PX16—Hayward Pool Products; "EcoStar Owner's Manual (Rev. B);" pp. 1-32; Elizabeth, NJ; cited in Civil Action 5:11-cv-00459D; 2010.
9PX17—Hayward Pool Products; "EcoStar & EcoStar SVRS Brochure;" pp. 1-7; Elizabeth, NJ; cited in Civil Action 5:11-cv-00459D; Sep. 30, 2011.
9PX19—Hayward Pool Products;"Hayward Energy Solutions Brochure;" pp. 1-3; www.haywardnet.com; cited in Civil Action 5:11-cv-00459D; Sep. 2011.
9PX20—Hayward Pool Products; "ProLogic Installation Manual (Rev. G);" pp. 1-25; Elizabeth, NJ; cited in Civil Action 5:11-cv-00459D; Sep. 2011.
9PX21—Hayward Pool Products; "ProLogic Operation Manual (Rev. F);" pp. 1-27; Elizabeth, NJ; cited in Civil Action 5:11-cv-00459D; Sep. 2011.
9PX22—Hayward Pool Products; "Wireless & Wired Remote Controls Brochure;" pp. 1-5; 2010; Elizabeth, NJ; cited in Civil Action 5:11-cv-00459D.
9PX23—Hayward Pool Products; Selected Pages from Hayward's Website:/www.hayward-pool.com; pp. 1-27; cited in Civil Action 5:11-cv-004590; Sep. 2011.
9PX28—Hayward Pool Products; "Selected Page from Hayward's Website Relating to EcoStar Pumps;" p. 1; cited in Civil Action 5:11-cv-00459D; Sep. 2011.
9PX29—Hayward Pool Products; "Selected Page from Hayward's Website Relating to EcoStar SVRS Pumps;" cited in Civil Action 5:11-cv-00459; Sep. 2011.
9PX30—Hayward Pool Systems; "Selected Pages from Hayward's Website Relating to ProLogic Controllers;" pp. 1-5; Civil Action 5:11-cv-00459D; Sep. 2011.
9PX-42—Hayward Pool Systems; "Hayward EcoStar & EcoStar SVRS Variable Speed Pumps Brochure;" Civil Action 5:11-cv-00459D; 2010.
205-24-Exh23—Piaintiff's Preliminary Disclosure of Asserted Claims and Preliminary Infringement Contentions; cited in Civil Action 5:11-cv-00459; Feb. 21, 2012.
PX-34—Pentair; "IntelliTouch Pool & Spa Control System User's Guide"; pp. 1-129; 2011; cited in Civil Action 5:11-cv-00459; 2011.
PX-138—Deposition of Dr. Douglas C. Hopkins; pp. 1-391; 2011; taken in Civil Action 10-cv-1662.
PX-141—Danfoss; "Whitepaper Automatic Energy Optimization;" pp. 1-4; 2011; cited in Civil Action 5:11-cv-00459.
9PX10—Pentair; "IntelliPro VS+SVRS Intelligent Variable Speed Pump;" 2011; pp. 1-6; cited in Civil Action 5:11-cv-00459D.
9PX11—Pentair; "IntelliTouch Pool & Spa Control Control Systems;" 2011; pp. 1-5; cited in Civil Action 5:11-cv-004590.
Robert S. Carrow; "Electrician's Technical Reference-Variable Frequency Drives;" 2001; pp. 1-194.
Baldor; "Balder Motors and Drives Series 14 Vector Drive Control Operating & Technical Manual;" Mar. 22, 1992; pp. 1-92.
Commander; "Commander SE Advanced User Guide;" Nov. 2002; pp. 1-118.
Baldor; "Baldor Series 10 Inverter Control: Installation and Operating Manual"; Feb. 2000; pp. 1-74.
Dinverter; "Dinverter 28 User Guide;" Nov. 1998; pp. 1-94.
Pentair Pool Products, "IntelliFlo 4x160 a Breakthrough Energy-Efficiency and Service Life; " pp. 1-4; Nov. 2005; www.pentairpool.com.
Pentair Water and Spa, Inc. "The Pool Pro's guide to Breakthrough Efficiency, Convenience & Profitability," pp. 1-8, Mar. 2006; www.pentairpool.com.

(56) References Cited

OTHER PUBLICATIONS

Danfoss; "VLT8000 Aqua Instruction Manual;" Apr. 16, 2004; pp. 1-71.
"Product Focus—New AC Drive Series Target Water, Wastewater Applications;" WaterWorld Articles; Jul. 2002; pp. 1-2.
Pentair; "Pentair RS-485 Pool Controller Adapter" Published Advertisement; Mar. 22, 2002; pp. 1-2.
Compool; "Compool CP3800 Pool-Spa Control System Installation and Operating Instructions;" Nov. 7, 1997; pp. 1-45.
Hayward; "Hayward Pro-Series High-Rate Sand Filter Owner's Guide," 2002; pp. 1-4.
Danfoss; "Danfoss VLT 6000 Series Adjustable Frequency Drive Installation, Operation and Maintenance Manual;" Mar. 2000; pp. 1-118.
Brochure entitled "Constant Pressure Water for Private Well Systems," for Myers Pentair Pump Group, Jun. 28, 2000.
Brochure for AMTROL, Inc. entitled "AMTROL unearths the facts about variable speed pumps and constant pressure calves," Mar. 2002.
Undated Goulds Pumps "Balanced Flow Systems" Installation Record.
Texas Instruments, Digital Signal Processing Solution for AC Induction Motor, Application Note, BPRA043 (1996).
Texas Instruments, Zhenyu Yu and David Figoli, DSP Digital Control System Applications—AC Induction Motor Control Using Constant V/Hz Principle and Space Vector PWM Technique with TM5320C240, Application Report No. SPRA284A (Apr. 1998).
Texas Instruments, TMS320F/C240 DSP Controllers Reference Guide Peripheral Library and Specific Devices, Literature No. SPRU 161D (Nov. 2002).
Texas Instruments, MSP430x33x—Mixed Signal Microcontrollers, SLAS 163 (Feb. 1998).
Microchip Technology, Inc., PICMicro Mid-Range MCU Family Reference Manual (Dec. 1997).
7—Motion for Preliminary Injunction by Danfoss Drives A/S & Pentair Water Pool & Spa, Inc. with respect to Civil Action No. 5:11-cv-00459D.
540X48—Hopkins; "Partitioning Oigitally . . . Applications to Ballasts;" pp. 1-6; cited in Civil Action 5:11-cv-00459D.
Load Controls Incorporated, product web pages including Affidavit of Christopher Butler of Internet Archive attesting to the authenticity of the web pages, dated Apr. 17, 2013, 19 pages.
Cliff Wyatt, "Monitoring Pumps," World Pumps, vol. 2004, Issue 459, Dec. 2004, pp. 17-21.
WEN Technology, Inc., Unipower® HPL110 Digital Power Monitor Installation and Operation, copyright 1999, pp. 1-20, Raleigh, North Carolina.
Wen Technology, Inc., Unipower® HPL110, HPL420 Programming Suggestions for Centrifugal Pumps, copyright 1999, 4 pages, Raleigh, North Carolina.
Danfoss, VLT® Aqua Drive, "The ultimate solution for Water, Wastewater, & Irrigation", May 2007, pp. 1-16.
Dan Foss, SALT Drive Systems, "Increase oil & gas production, Minimize energy consumption", copyright 2011, pp. 1-16.
Schlumberger Limited, Oilfield Glossary, website Search Results for "pump-off", copyright 2014, 1 page.
45-Piaintiffs' Reply to Defendants' Answer to Complaint & Counterclaim for Civil Action 5:11-cv-00459D.
50—Amended Answer to Complaint & Counterclaim by Defendants for Civil Action 5:11-cv-00459D.
54DX32—Hopkins; "High-Temperature, High-Density . . . Embedded Operation;" pp. 1-8; cited in Civil Action 5:11-cv-00459D.
Pent Air; "Pentair IntelliTouch Operating Manual;" May 22, 2003; pp. 1-60.
USPTO Patent Trial and Appeal Board, Paper 43—Final Written Decision, Case IPR2013-00287, U.S. Pat. No. 7,704,051 B2, Nov. 19, 2014, 28 pages.
Danfoss, VLT 8000 Aqua Operating Instructions, coded MG.80.A2.02 in the footer, 181 pages.
Per Brath—Danfoss Drives A/S, Towards Autonomous Control of HVAC Systems, thesis with translation of Introduction, Sep. 1999, 216 pages.
Karl Johan Aström and Björn Wittenmark—Lund Institute of Technology, Adaptive Control—Second Edition, book, Copyright 1995, 589 pages, Addison-Wesley Publishing Company, United States and Canada.
Bimal K. Bose—The University of Tennessee, Knoxville, Modem Power Electronics and AC Drives, book, Copyright 2002, 728 pages, Prentice-Hall, Inc., Upper Saddle River, New Jersey.
Waterworld, New AC Drive Series Targets Water, Wastewater Applications, magazine, Jul. 2002, 5 pages, vol. 18, Issue 7.
Texas Instruments, TMS320F/C240 DSP Controllers Peripheral Library and Specific Devices, Reference Guide, Nov. 2002, 485 pages, printed in U.S.A.
Microchip Technology Inc., PICmicro® Advanced Analog Microcontrollers for 12-Bit ADC on 8-Bit MCUs, Convert to Microchip, brochure, Dec. 2000, 6 pages, Chandler, Arizona.
W.K. Ho, S.K. Panda, K.W. Lim, F.S. Huang—Department of Electrical Engineering, National University of Singapore, Gain-scheduling control of the Switched Reluctance Motor, Control Engineering Practice 6, copyright 1998, pp. 181-189, Elsevier Science Ltd.
Jan Eric Thorsen—Danfoss, Technical Paper—Dynamic simulation of DH House Stations, presented by 7. Dresdner Femwärme-Kolloquium Sep. 2002, 10 pages, published in Euro Heat & Power Jun. 2003.
Texas Instruments, Electronic TMS320F/C240 DSP Controllers Reference Guide, Peripheral Library and Specific Devices, Jun. 1999, 474 pages.
Rajwardhan Patil, et al., A Multi-Disciplinary Mechatronics Course with Assessment—Integrating Theory and Application through Laboratory Activities, International Journal of Engineering Education, copyright 2012, pp. 1141-1149, vol. 28, No. 5, TEMPUS Publications, Great Britain.
James Shirley, et al., A mechatronics and material handling systems laboratory: experiments and case studies, International Journal of Electrical Engineering Education 48/1, pp. 92-103.
U.S. Court of Appeals for the Federal Circuit, Notice of Entry of Judgment, accompanied by Opinion, in Case No. 2017-1021, Document 57-1, filed and entered Feb. 7, 2018, pp. 1-16.
U.S. Court of Appeals for the Federal Circuit, Notice of Entry of Judgment, accompanied by Opinion, in Case No. 2017-1124, Document 54-1, filed and entered Feb. 26, 2018, pp. 1-10.
U.S. Patent Trial and Appeal Board's Rule 36 Judgment, without opinion, in Case No. 2016-2598, dated Aug. 15, 2017, pp. 1-2.

* cited by examiner

VARIABLE SPEED PUMPING SYSTEM AND METHOD

RELATED APPLICATIONS

This application is a continuation of U.S. application Ser. No. 10/926,513 filed on Aug. 26, 2004, the entire contents of which is incorporated herein by reference.

FIELD OF THE INVENTION

The present invention relates generally to pumps, and more particularly to variable speed pumping systems for pools and other aquatic applications that are operable in response to a sensed condition and/or a user input instruction.

BACKGROUND OF THE INVENTION

Conventionally, a pump to be used in an aquatic application such as a pool or a spa is operable at a finite number of predetermined speed settings (e.g., typically high and low settings). Typically these speed settings correspond to the range of pumping demands of the pool or spa at the time of installation. Factors such as the volumetric flow rate of water to be pumped, the total head pressure required to adequately pump the volume of water, and other operational parameters determine the size of the pump and the proper speed settings for pump operation. Once the pump is installed, the speed settings typically are not readily changed to accommodate changes in the pumping demands.

Installation of the pump for an aquatic application such as a pool entails sizing the pump to meet the pumping demands of that particular pool and any associated features. Because of the large variety of shapes and dimensions of pools that are available, precise hydraulic calculations must be performed by the installer, often on-site, to ensure that the pumping system works properly after installation. The hydraulic calculations must be performed based on the specific characteristics and features of the particular pool, and may include assumptions to simplify the calculations for a pool with a unique shape or feature. These assumptions can introduce a degree of error to the calculations that could result in the installation of an unsuitably sized pump. Essentially, the installer is required to install a customized pump system for each aquatic application.

A plurality of aquatic applications at one location requires a pump to elevate the pressure of water used in each application. When one aquatic application is installed subsequent to a first aquatic application, a second pump must be installed if the initially installed pump cannot be operated at a speed to accommodate both aquatic applications. Similarly, features added to an aquatic application that use water at a rate that exceeds the pumping capacity of an existing pump will need an additional pump to satisfy the demand for water. As an alternative, the initially installed pump can be replaced with a new pump that can accommodate the combined demands of the aquatic applications and features.

During use, it is possible that a conventional pump is manually adjusted to operate at one of the finite speed settings. Resistance to the flow of water at an intake of the pump causes a decrease in the volumetric pumping rate if the pump speed is not increased to overcome this resistance. Further, adjusting the pump to one of the settings may cause the pump to operate at a rate that exceeds a needed rate, while adjusting the pump to another setting may cause the pump to operate at a rate that provides an insufficient amount of flow and/or pressure. In such a case, the pump will either operate inefficiently or operate at a level below that which is desired.

Accordingly, it would be beneficial to provide a pump that could be readily and easily adapted to provide a suitably supply of water at a desired pressure to aquatic applications having a variety of sizes and features. The pump should be customizable on-site to meet the needs of the particular aquatic application and associated features, capable of pumping water to a plurality of aquatic applications and features, and should be variably adjustable over a range of operating speeds to pump the water as needed when conditions change. Further, the pump should be responsive to a change of conditions and/or user input instructions.

SUMMARY OF THE INVENTION

In accordance with one aspect, the present invention provides a variable speed pumping system for moving water of an aquatic application. The variable speed pumping system includes a water pump for moving water in connection with performance of an operation upon the water. A variable speed motor is operatively connected to drive the pump. A sensor for senses a parameter of the operation performed upon the water. A controller controls speed of the motor in response to the sensed parameter of operation.

In accordance with another aspect, the present invention provides a method of operating a variable speed pumping system for moving water of an aquatic application. A water pump is driven for moving water in connection with performance of an operation upon the water. A variable speed motor connected and operated to drive the pump. A parameter of the operation performed upon the water is sensed. The speed of the motor is controlled in response to the sensed parameter of operation.

BRIEF DESCRIPTION OF THE DRAWINGS

The foregoing and other features and advantages of the present invention will become apparent to those skilled in the art to which the present invention relates upon reading the following description with reference to the accompanying drawings, in which.

DESCRIPTION OF AN EXAMPLE EMBODIMENT

Figure 1:
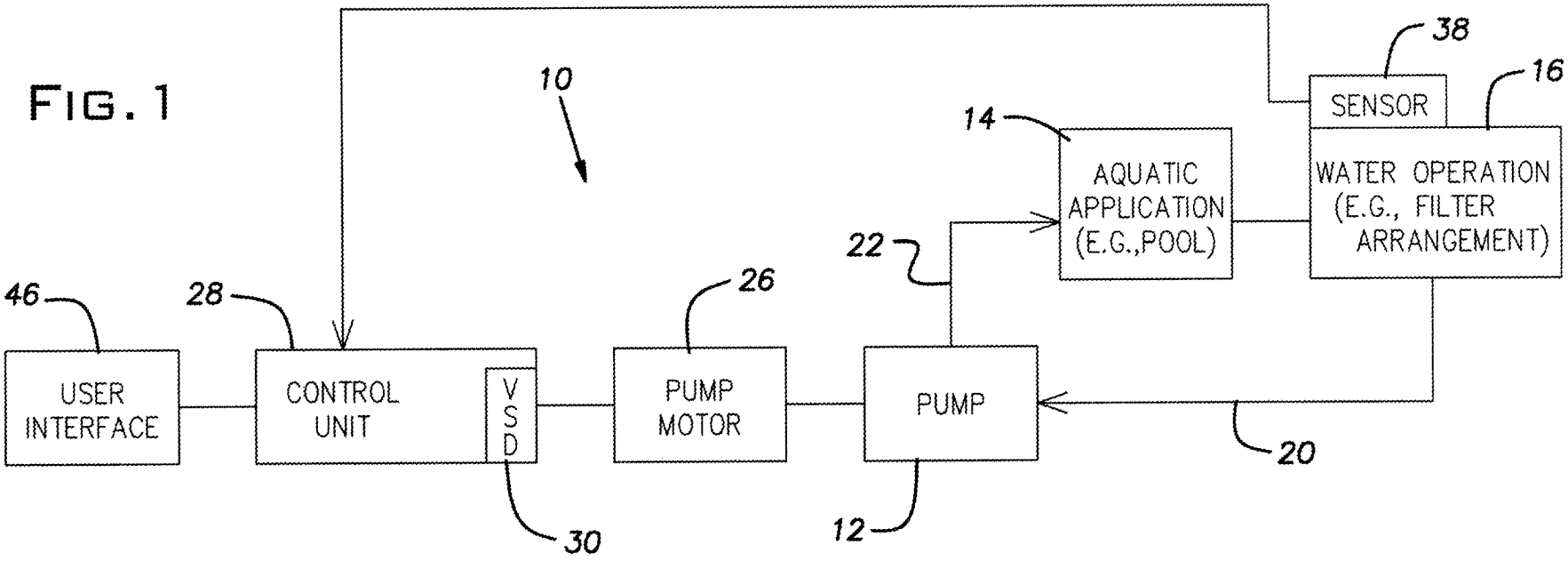
FIG. 1 is a block diagram of an example of a variable speed pumping system in accordance with the present invention with a pool environment.

Certain terminology is used herein for convenience only and is not to be taken as a limitation on the present invention. Further, in the drawings, the same reference numerals are employed for designating the same elements throughout the figures, and in order to clearly and concisely illustrate the present invention, certain features may be shown in somewhat schematic form.

An example variable-speed pumping system 10 in accordance with the present invention is schematically shown in FIG. 1. The pumping system 10 includes a pump 12 that is shown as being used with a pool 14 environment. The pool 14 is one example of an aquatic application with which the present invention may be utilized. The phrase "aquatic application" is used generally herein to refer to any reservoir, tank, container or structure, natural or man-made, having a fluid, capable of holding a fluid, to which a fluid is delivered, or from which a fluid is withdrawn. Further, "aquatic application" encompasses any feature associated with the operation, use or maintenance of the aforementioned reservoir, tank, container or structure. This definition of "aquatic application" includes, but is not limited to pools, spas, whirlpool baths, landscaping ponds, water jets, waterfalls, fountains, pool filtration equipment, pool vacuums, spillways and the like. Although each of the examples provided above includes water, additional applications that include liquids other than water are also within the scope of the present invention. Herein, the terms pool and water are used with the understanding that they are not limitations on the present invention.

Within the shown example, a filter arrangement 16 is associated with the pumping system 10 and the pool 14 for providing a cleaning operation (i.e., filtering) on the water within the pool. The filter arrangement 16 is operatively connected between the pool 14 and the pump 12 at/along an inlet line 20 for the pump. It is to be appreciated that the function of filtering is but one example of an operation that can be performed upon the water. Other operations that can be performed upon the water may be simplistic, complex or diverse. For example, the operation performed on the water may merely be just movement of the water by the pumping system 10 (e.g., re-circulation of the water in a waterfall or spa environment).

Turning to the filter arrangement 16, any suitable construction and configuration of the filter arrangement is possible. For example, the filter arrangement 16 may include a skimmer assembly for collecting coarse debris from water being withdrawn from the pool 14, and one or more filter components for straining finer material from the water.

The pump 12 may have any suitable construction and/or configuration for providing the desired force to the water and move the water. In one example, the pump 12 is a common centrifugal pump of the type known to have impellers extending radially from a central axis. Vanes defined by the impellers create interior passages through which the water passes as the impellers are rotated. Rotating the impellers about the central axis imparts a centrifugal force on water therein, and thus imparts the force flow to the water. A return line 22 directs the return flow of water to the pool. Although centrifugal pumps are well suited to pump a large volume of water at a continuous rate, other motor-operated pumps may also be used within the scope of the present invention.

Drive force is provided to the pump via a pump motor 26. In the one example, the drive force is in the form of rotational force provided to rotate the impeller of the pump 12. In one specific embodiment, the pump motor 26 is a permanent magnet motor. In another specific embodiment, the pump motor 26 is a three-phase motor. The pump motor 26 operation is infinitely variable within a range of operation (i.e., zero to maximum operation). In one specific example, the operation is indicated by the RPM of the rotational force provided to rotate the impeller of the pump 12.

A control unit 28 provides for the control of the pump motor 26 and thus the control of the pump 12. Within the shown example, the control unit 28 includes a variable speed drive 30 that provides for the infinitely variable control of the pump motor 26 (i.e., varies the speed of the pump motor). By way of example, within the operation of the variable speed drive 30 a single phase AC current from a source power supply is converted (e.g., broken) into a three-phase DC current. Any suitable technique and associated construction/configuration may be used to provide the three-phase DC current may be used. For example, the construction may include capacitors to correct line supply over or under voltages. The variable speed drive 30 supplies the DC electric power at a changeable frequency to the pump motor 26 to drive the pump motor. The construction and/or configuration of the pump 12, the pump motor 26, the control unit 28, as a whole, and the variable speed drive 30, as a portion of the control unit, are not limitations on the present invention. In one possibility, these components are disposed within a single housing to form a single unit.

A sensor 34 of the pumping system 10 senses a parameter indicative of the operation performed upon the water. In the shown example, the sensor 34 is operatively connected with the filter arrangement 16 and senses an operation characteristic associated with the filter arrangement. For example, the sensor 34 may monitor filter performance. Such monitoring may be as basic as monitoring flow rate, pressure, or some other parameter that indicates performance. Of course, it is to be appreciated that the sensed parameter of operation may be otherwise associated with the operation performed upon the water. As such, the sensed parameter of operation can be as simplistic as a flow indicative parameter such as rate, pressure, etc. The sensor 34 is also operatively connected to the control unit 28 to provide the sensory indication thereto.

It is to be appreciated that the sensor can be otherwise connected and otherwise operated. For example, the sensor 34 may sense a parameter, such as flow rate or pressure, which is indicative of the pump moving the water but is also indicative of the lack of the water movement. Such an indication can be used within the program as an indication of an obstruction (e.g., by a person or large debris object). Such indication information can be used by the program to perform various functions, and examples of such are set forth below. Also, it is to be appreciated that additional functions and features may be separate or combined, and that sensor information may be obtained by one or more sensors. The example concerning obstruction can be considered to be an example operation upon the water. Further, the example can be considered to be an example of an abnormal operation on the water (i.e., no water movement).

With regard to the specific example of monitoring operation performance of the filter arrangement 16, the signal from the sensor 34 can indicate impediment or hindrance can be any obstruction or condition, whether physical, chemical, or mechanical in nature, that interferes with the flow of water from the aquatic application to the pump 12 such as debris accumulation or the lack of accumulation, within the filter arrangement 16.

Turning back to the shown example, the sensor 34 is of a kind to detect any one or more conditions indicative of the volume, rate, mass, pressure, or any other condition of water being moved through the filter arrangement 16 to the pump via the inlet line 20. Also, the condition may be associated with the operation, effectiveness, etc. of the filter operation. By monitoring such condition(s), operation performance can be determined. It is to be noted that in the shown example, the sensor 34 is shown in connection with the filter arrangement 16. However, it is to be appreciated that the sensor 34 can be located at other points along the flow path. Also, the shown example has only a single sensor. It is to be appreciated that multiple sensors are possible.

As indicated above, the speed of operation of the pump 12 is determined in response to a sensed operation parameter. In one example, the operation is based upon an approach in which the pump is controlled to operate at a lowest amount that will accomplish the desired task (e.g., maintain a desired filtering level of operation). Specifically, as the sensed parameter changes, the lowest level of pump operation (i.e., pump speed) to accomplish the desired task will need to change. The control unit 28 provides the control to operate the pump motor/pump accordingly. In other words, the control unit 28 repeatedly adjusts the speed of the pump motor 26 to a minimum level responsive to the sensed parameter to maintain the sensed parameter of operation at a level. Such an operation mode can provide for minimal energy usage.

Focusing on the aspect of minimal energy usage, within some know pool filtering applications, it is common to operate a known pump/filter arrangement for some portion (e.g., eight hours) of a day at effectively a very high speed to accomplish a desired level of pool cleaning. With the present invention, the pumping system 10 with the associated filter arrangement 16 can be operated continuously (e.g., 24 hours a day) at an ever-changing minimum level to accomplish the desired level of pool cleaning. It is possible to achieve a very significant savings in energy usage with such a use of the present invention as compared to the known pump operation at the high speed. In one example, the cost savings would be in the range of 90% as compared to a known pumpfilter arrangement.

Aquatic applications will have a variety of different water demands depending upon the specific attributes of each aquatic application. Turning back to the aspect of the pump that is driven by the infinitely variable motor, it should be appreciated that precise sizing, adjustment, etc. for each application of the pump system for an aquatic application can thus be avoided. In many respects, the pump system is self adjusting to each application.

It is to be appreciated that the control unit 28 may have various forms to accomplish the desired functions. In one example, the control unit 28 includes a computer processor that operates a program. In the alternative, the program may be considered to be an algorithm. The program may be in the form of macros. Further, the program may be changeable, and the control unit 28 is thus programmable.

Figure 2:
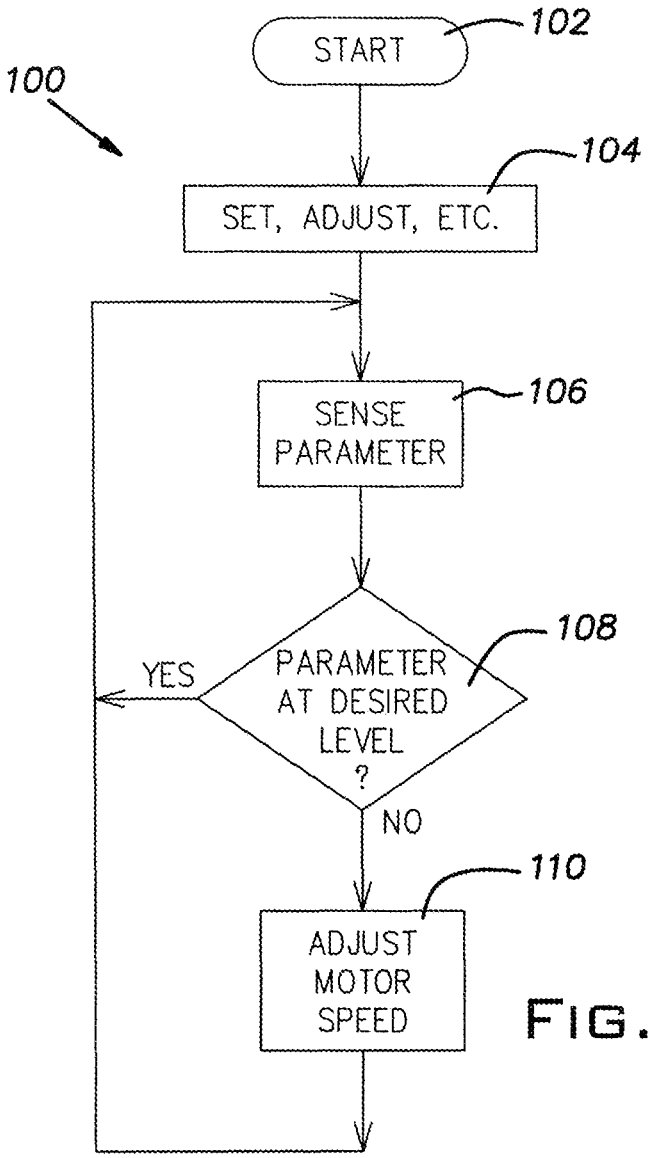
FIG. 2 is a top-level flowchart for an example method in accordance with the present invention.

In one method of control, testing can be done to determine a lowest point of operation that provides the desired response. Such a lowest point of operation is then set as a minimum (e.g. a floor). As the pumping system 10 is operated, the sensed parameter is monitored to determine a needed change in pump speed. As the parameter changes the speed of the pump 12 is changed. In one specific example, the minimum (e.g., floor) speed is continuously changed in response to the sensed parameter. FIG. 2 is a top-level flow chart that shows an example method 100 of operation. The method 100 is initiated at step 102 and proceeds to step 104, wherein various initial values are set, adjusted, etc. At step 106, the parameter is sensed. At step 108, a determination is made as to whether the parameter is a desired level. If the determination is affirmative (i.e., the parameter is at the desired level), the method returns to sense the parameter again at step 106. However, if the determination at step 108 is negative (i.e., the parameter is not at the desired level), the motor speed is adjusted accordingly at step 110. The method 100 then proceeds to sense the parameter again at step 106. It is to be appreciated that the parameter may indicate sufficient level of filtering, insufficient level of filtering, or excessive level of filter, and the motor is adjusted accordingly. Also, it is to be appreciated that various change amounts, change delays, etc. may be incorporated into the method.

Turning to the aspect that other, different, and/or additional functions can be performed by the system 10 in accordance with the present invention. As mentioned above, the sensory input can be used to determine an obstruction. Various functions can be accomplished in response to such sensory information. In one example, the program can control the motor to cease operation until the obstruction is removed. This will help prevent unnecessary strain on the motor and/or pump and can help prevent entrapment.

Some example of other functions that can be provided, either alone or in combination with one or more other functions, include using sensory information to determine heater operation and loss of pump prime. Turning to heater operation, it is to be appreciated that the pool, other aquatic application, may include a heater that provides heat to the water being moved such that returned water is warmer. It is possible that the heat requires a minimum threshold of water movement for proper operation. As such, a sensor, which could merely be a signal input from the heater, could be utilized to provide an indication of operation of heater applying heat to the water. During such heater operation, the program can operate the motor/pump in a different desired manner. For example, the motor/pump may be operated to increase (e.g., ramp-up) the flow rate to ensure that at least a predetermined amount of water flows by the heater to absorb the heat being proved by the heater. Such an operation may help prevent damage to the heater. With regard to the loss of prime at the pump, sensory information concerning an event can be obtained and utilized. Obtaining an indication of loss of prime may be by any sensory means, including but not limited to sensed lack of flow. The program can utilize the information to cease operation of the motor/pump. Such an operation may help prevent damage to the motor/pump. These examples can be considered to be examples of pump system components performing operations on the water. Also, the example concerning loss of prime can be considered to be an example of an abnormal operation on the water (i.e., no water movement).

Focusing upon the controllability of the pump operation, it is to be appreciated that the control unit 28 may include a memory (not shown) to store information that correlates sensed data and/or user input data with speed data of the pump 12. In order to provide user input, the shown example pumping system includes a user interface 46 having means 48 (FIG. 3) for inputting a desired operation of the pumping system 10 is provided within the example system. The interface 46 also provides a means 50 to receive indication information from the control unit 28. Within the shown example, input is provided via selectors 48 for input of desired operation for the motor/pump, and a display portion 50 provides information pertaining to the operation of the pumping system 10.

It is to be appreciated that the pump motor 26 (FIG. 1) may be operated within other modes. Some of the modes may be based upon input from the sensor and some of the modes may be based upon other criteria or input. In one example, the operation may be based upon input provided via the user interface 46. One specific example of a mode that can be entered via use of the user interface is operation of the pump 12 at an increased level when it is desired to utilize an accessory cleaning implement within the pool 14. Also, the pumping system 10 can be placed into an idle mode (e.g., when the pool 14 is being otherwise serviced) or a completely off mode to conserve electric power.

Figure 3:
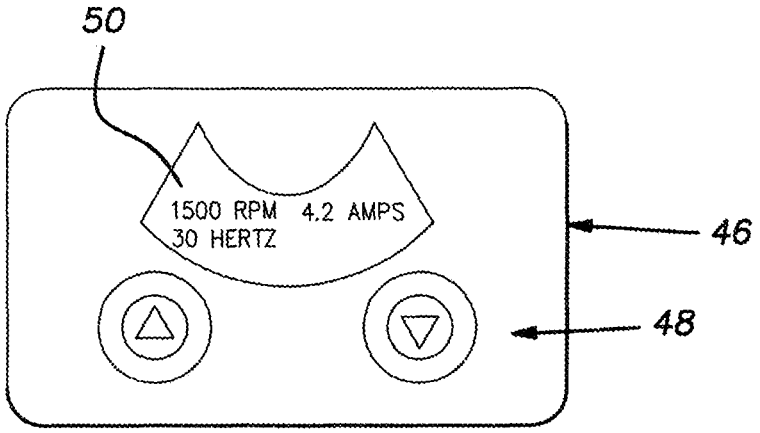
FIG. 3 is an illustration of a user interface for one example of the pumping system of FIG. 1.
Figure 4:
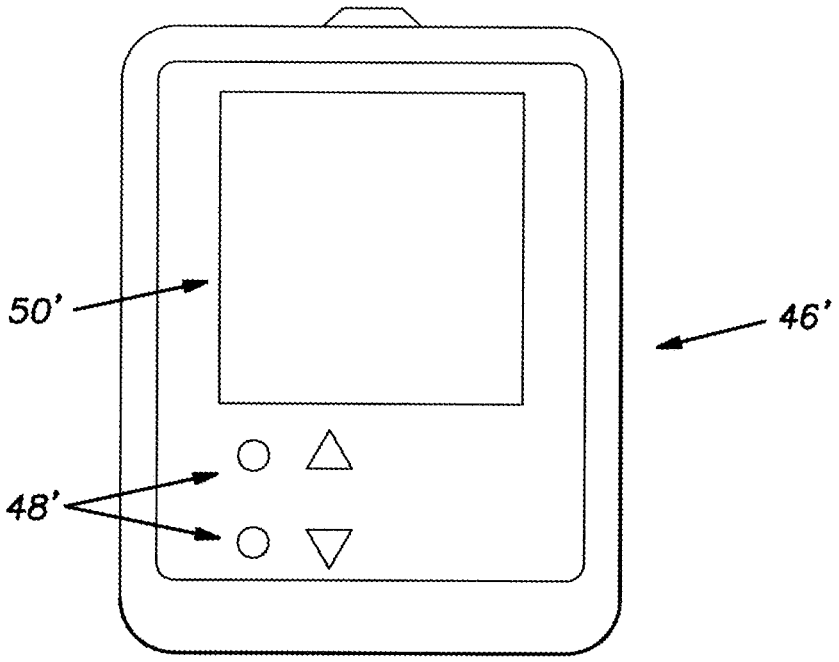
FIG. 4 is an illustration of a user interface for another example of the pumping system of FIG. 1.

As shown in FIG. 4, a remote user interface 46' can be used with, or in place of the user interface 46 shown in FIG. 3. The remote user interface 46' communicates with the control unit 28 via a radio signal, IR beam, or the like.

Turning to an aspect of control, it is to be appreciated that the pumping system 10, and in particular the program performed within the control unit 28 is operatable as a freestanding or autonomous system, as shown in the presented example. However, it is to be appreciated that the pumping system 10, and in particular the program, may be operated as a part of an overall arrangement. For example, an automation controller may be used to control the program, and thus the pumping system 10, along with other systems, devices, aspects, etc. associated the pool or aquatic application. In one embodiment, the pumping system 10, and the program performed therein, is controlled as a slave to the master of the automation controller. It is to be appreciated that suitable communication interconnections are proved within such an overall arrangement.

It should be evident that this disclosure is by way of example and that various changes may be made by adding, modifying or eliminating details without departing from the scope of the teaching contained in this disclosure. As such it is to be appreciated that the person of ordinary skill in the art will perceive changes, modifications, and improvements to the example disclosed herein. Such changes, modifications, and improvements are intended to be within the scope of the present invention.

The invention claimed is:

1. A pumping system, the pumping system adapted to be coupled to a pool, a pool filter, a pool heater, and a pool vacuum, the pumping system comprising:

a centrifugal pump;

a variable speed electric motor coupled to drive the centrifugal pump;

a heater sensor adapted to provide an indication of operation of the pool heater;

a filtration level sensor adapted to sense a parameter indicative of a current filtering level of operation; and a controller in communication with the variable speed electric motor, the heater sensor, and the filtration level sensor, the controller configured to determine a current value of at least one of a volume, a flow rate, a mass, and a pressure in the pumping system associated with the current filtering level of operation by monitoring the parameter of the filtration level sensor that is indicative of the current filtering level of operation, the controller configured to determine a current operational state of the pool heater in the pumping system associated with the indication of heater operation provided by the heater sensor;

the controller configured to continuously modify an actual speed of the variable speed electric motor to a minimum floor speed that the controller determines to be a highest speed required between a comparison of a minimum filter speed necessary to achieve a desired filtering level of operation, and a predetermined pump heater speed for use during operation of the pool heater.

2. The pumping system of claim 1, wherein the controller is configured to increase flow during operation of the pool vacuum.

3. The pumping system of claim 1, wherein the controller is configured to enter an idle mode while the pumping system is being serviced.

4. The pumping system of claim 1, wherein the controller is configured to determine that the pump has lost prime.

5. The pumping system of claim 1, wherein the controller is configured to determine that there is an obstruction in the pumping system and automatically stops flow.

6. The pumping system of claim 1, wherein an aquatic application is added to the pumping system and wherein the controller is configured to self-adjust the actual speed of the variable speed electric motor to operate at a new minimum speed to achieve the desired filtering level of operation with substantially minimal energy usage.

7. The pumping system of claim 1, and further comprising another sensor adapted to sense at least one of volume, flow rate, mass, and pressure, the another sensor being in communication with the controller.

8. The pumping system of claim 1, further comprising a user interface in communication with the controller.

9. The pumping system of claim 8, wherein the user interface includes at least one of a display and a plurality of selectors.

10. The pumping system of claim 8, wherein the user interface includes a remote user interface.

11. The pumping system of claim 10, wherein the controller is coupled to the remote user interface through a wireless connection.

12. The pumping system of claim 11, wherein the wireless connection includes at least one of a radio signal connection and an infrared beam connection.

13. The pumping system of claim 8, and further comprising a single housing encasing the pump, the variable speed electric motor, the user interface, and the controller.

14. The pumping system of claim 1, wherein the variable speed electric motor includes a permanent magnet motor.

15. The pumping system of claim 1, wherein the variable speed electric motor includes a three-phase motor.

16. The pumping system of claim 8, and further comprising a remote user interface used with the user interface and adapted to be in communication with the controller.

* * * * *